US007403735B2

(12) United States Patent
Yasutomi et al.

(10) Patent No.: US 7,403,735 B2
(45) Date of Patent: Jul. 22, 2008

(54) IMAGE FORMATION APPARATUS USING AN ELECTROPHOTOGRAPHIC PROCESS

(75) Inventors: Kei Yasutomi, Kanagawa (JP); Yasuo Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/349,960

(22) Filed: Jan. 24, 2003

(65) Prior Publication Data

US 2003/0215264 A1 Nov. 20, 2003

(30) Foreign Application Priority Data

Jan. 24, 2002 (JP) ..... 2002-016250

(51) Int. Cl.
*G03G 15/02* (2006.01)
*G03G 5/047* (2006.01)

(52) U.S. Cl. ..... 399/159; 430/58.65; 430/58.85; 430/59.2; 399/168; 399/176; 347/130; 347/131

(58) Field of Classification Search ..... 430/58.05, 430/59.2, 58.65, 58.85; 399/159, 170, 168, 399/176; 347/130, 131, 129, 139; 358/461
See application file for complete search history.

(56) References Cited

U.S. PATENT DOCUMENTS

| | | | | |
|---|---|---|---|---|
| 4,537,847 | A * | 8/1985 | Takahashi et al. | 430/59.3 |
| 4,898,800 | A * | 2/1990 | Shimada et al. | 430/58.65 |
| 5,029,227 | A * | 7/1991 | Kawamura | 382/282 |
| 5,294,509 | A * | 3/1994 | Ashiya et al. | 430/58.05 |
| 5,459,247 | A * | 10/1995 | Hashimoto | 534/658 |
| 5,578,405 | A | 11/1996 | Ikegami et al. | 430/76 |
| 5,665,500 | A | 9/1997 | Suzuki | 430/66 |
| 5,677,096 | A | 10/1997 | Suzuki | 430/60 |
| 5,740,494 | A | 4/1998 | Shoiji et al. | 399/71 |
| 5,928,828 | A | 7/1999 | Suzuki | 430/126 |
| 5,999,773 | A | 12/1999 | Yasutomi et al. | 399/148 |
| 6,026,262 | A | 2/2000 | Kinoshita et al. | 399/252 |
| 6,030,736 | A | 2/2000 | Ikegami et al. | 430/59.6 |
| 6,136,483 | A | 10/2000 | Suzuki et al. | 430/58.7 |
| 6,183,922 | B1 * | 2/2001 | Takai et al. | 430/72 |
| 6,366,751 | B1 | 4/2002 | Shakuto et al. | 399/159 |
| 6,426,825 | B1 | 7/2002 | Inagaki | |
| 6,656,652 | B2 * | 12/2003 | Ishii et al. | 430/59.3 |
| 6,800,410 | B2 * | 10/2004 | Yasutomi et al. | 430/35 |
| 6,818,368 | B2 * | 11/2004 | Tanaka et al. | 430/73 |
| 2001/0022343 | A1 * | 9/2001 | Sakai et al. | 250/234 |
| 2001/0055504 | A1 * | 12/2001 | Itoh | 399/296 |
| 2002/0028400 | A1 * | 3/2002 | Shimada et al. | 430/58.05 |
| 2002/0106570 | A1 * | 8/2002 | Kami et al. | 430/58.05 |
| 2003/0206226 | A1 * | 11/2003 | Kurimoto et al. | 347/132 |

FOREIGN PATENT DOCUMENTS

| | | | |
|---|---|---|---|
| JP | 52-036016 | | 3/1977 |
| JP | 01-200261 | * | 8/1989 |
| JP | 06-301286 | | 10/1994 |
| JP | 7-128890 A | * | 5/1995 |
| JP | 08-020210 | | 1/1996 |
| JP | 08-272197 | | 10/1996 |
| JP | 08-286470 | | 11/1996 |
| JP | 09-319164 | | 12/1997 |
| JP | 10-63021 | | 3/1998 |
| JP | 10-177273 | | 6/1998 |
| JP | 11-095462 | | 4/1999 |
| JP | 11-282180 | * | 10/1999 |
| JP | 2000-105478 | | 4/2000 |
| JP | 2000-350027 | | 12/2000 |
| JP | 2001-75037 | | 3/2001 |
| JP | 2001-201876 | | 7/2001 |

OTHER PUBLICATIONS

USPTO English-Language Translation of JP01-200261, pub Aug. 1989.*

Diamond, A.S., ed. *Handbook of Imaging Materials*, Marcel Dekker, Inc. New York (1991), pp. 395-396.*

Thomas-Derwent machine-assisted translation of JP 7-128890 A (pub. May 1995).*

Kirk-Othmer Encyclopedia of Chemical Technology, fourth edition, vol. 15, John Wiley & Sons, NY (1995), pp. 21-24.*

AIPN Japanese Patent Office machine-assisted translation of JP 11-282180 (pub. Oct. 1999).*

U.S. Appl. No. 10/244,444, filed Sep. 17, 2002, Suzuki, et al.

U.S. Appl. No. 10/235,961, filed Sep. 6, 2002, Ikegami, et al.

U.S. Appl. No. 10/175,799, filed Jun. 21, 2002, Li, et al.

U.S. Appl. No. 10/090,745, filed Mar. 6, 2002, Suzuki, et al.

U.S. Appl. No. 09/846,224, filed May 2, 2001, Matsuura, et al.

U.S. Appl. No. 09/873,246, filed Jun. 5, 2001, Takeuchi, et al.

U.S. Appl. No. 09/679,480, filed Oct. 5, 2000, Suzuki, et al.

U.S. Appl. No. 09/708,659, filed Nov. 9, 2000, Yasutomi, et al.

U.S. Appl. No. 08/550,808, filed Oct. 31, 1995, Suzuki.

(Continued)

*Primary Examiner*—Janis L Dote
(74) *Attorney, Agent, or Firm*—Oblon, Spivak, McClelland, Maier & Neustadt, P.C.

(57) ABSTRACT

An image formation apparatus using an elecrophotographic process for obtaining a high quality image with tone value $R^2$ of equal to or more than 0.98 is provided. The resolution for light-writing is equal to or more than 1200 dpi and/or light-writing is performed based on image data formed by applying halftone processing at a line frequency of equal to or more than 200 lpi. Light-writing means is accomplished with a laser light beam with a beam diameter equal to or less than 35 μm. The photoconductor includes a charge generating layer containing a charge generating material and a charge transfer layer containing a charge transfer material laminated on a conductive support. The ionization potential of the charge generating material Ip(CG) and ionization potential of the charge transfer material Ip(CT) satisfy the relationship of Ip(CG)≧Ip(CT).

9 Claims, 7 Drawing Sheets

OTHER PUBLICATIONS

Electrophotography Society, "Electrophotography—Bases and Applications", Corona Publishing Co., Ltd., Jun. 15, 1988, Japan, pp. 1, 150-151 and 734.
U.S. Appl. No. 10/769,855, filed Feb. 3, 2004, Watanabe et al.
U.S. Appl. No. 10/784,872, filed Feb. 24, 2004, Shimada, et al.
U.S. Appl. No. 10/856,962, filed Jun. 1, 2004, Ikegami, et al.
U.S. Appl. No. 10/960,049, filed Oct. 8, 2004, Yasutomi et al.

* cited by examiner

IMAGE FORMATION APPARATUS USING AN ELECTROPHOTOGRAPHIC PROCESS

BACKGROUND OF THE INVENTION

1. Field of the Invention

The present invention relates to an image formation apparatus using an electrophotographic process, such as an electrostatic copier and a laser printer, more particularly, an image formation apparatus using an electrophotogrphic process of which a light-writing resolution is equal to or more than 1200 dpi. Also the present invention relates to an image formation apparatus in which light writing is performed based on image data obtained by applying halftone processing at a line frequency of equal to or more than 200 lpi to an input image.

2. Description of the Related Art

Conventionally, an image formation apparatus is disclosed in Japanese Laid-Open Patent Application No. 8-272197, which includes an electrophotographic photoconductor having a photosensitive layer on a support, charging means for charging the photoconductor, light-exposure means for irradiating light on the charged electrophotographic photoconductor, developing means, and transcribing means, wherein the product of the spot area of light radiated from the light-exposure means and the thickness of the photosensitive layer is equal to or less than 20,000 $\mu m^3$.

Thus, an image formation apparatus and a process cartridge are provided which could obtain an image with high resolution and good tone.

The prior art characterized by satisfying the certain condition:

$$Vc/Vo \leqq 0.92 \log(S) - 0.018L - 0.29$$

is also disclosed in Japanese Laid-Open Patent Application No. 9-319164, wherein Vc[V] is a contrast voltage, Vo[V] is an initial electric potential, and S[μm] is a laser beam diameter.

Thus, even if the thickness of a charge transfer layer is comparable with the conventional one, the deterioration of a latent image is avoided and the resolution of the latent image is improved so that an image with a high density and a high fineness could be reproduced.

Also, the prior art disclosed in Japanese Laid-Open Patent Application No. 11-95462 is characterized in that a charge transfer layer of a photoconductor contains at least one kind of reaction product of a compound represented by $$R^1{}_m\text{-M-}(OR^2)_n,\ (M=Si, Al, Ti, Zr)$$

Thus, in sequential image formation with repeated charging and light-exposure, film chipping caused by wear and flaw of the layer is reduced and the layer has a high durability so that a photosensitive layer could be thinned. As a result, an electrophotographic photoconductor is provided on which a high quality image output with good tone and reproducibility could be obtained.

Next, an image formation apparatus using an electrophotographic process will be schematically illustrated.

FIG. 1 is a schematic diagram of a conventional image formation apparatus. A photoconductor drum 1 is formed by applying a photoconductor on the surface of a conductor and rotates in the direction designated by the arrow shown in FIG. 1. Image formation is performed by the following procedure in the image formation apparatus.

1. Charging means 2 electrifies the surface of the photoconductor at a desired electric potential.

2. Light-exposure means 3 exposes the photoconductor to light and forms an electrostatic latent image corresponding to a desired image on the photoconductor.
3. Developing means 4 develops the electrostatic latent image formed by the light-exposure means by toners and forms a toner image on the photoconductor.
4. Transcribing means 5 transcribes the toner image on the photoconductor to a recording sheet 6 such as a paper carried by a carrying means not shown in the figure.
5. Cleaning means 7 cleans toners that are not transcribed on the recording sheet by the transcribing means and remain on the photoconductor.
6. The recording sheet on-which the toner image is transcribed by the transcribing means 5 is carried into fixing means 8. In the fixing means 8, the toners are heated and fixed on the recording sheet.

The photoconductor drum rotates in the direction designated by the arrow in FIG. 1 and desired images are formed on the recording sheets by repeating the aforementioned processes 1 through 6.

Conventionally, as a charging device in the electrophotorgaphic process, a corona charging device has been used, in which a photoconductor is charged by utilizing corona discharge. FIG. 2 is a schematic diagram of one example of the corona charging device. The material of the wire is tungsten and the diameter of the wire is 60 μm. The wire is extended and set at the position (the center of a charging case) as shown in FIG. 2 along the directions of the rotational axis of the photoconductor drum, on which wire a high voltage (approximately −7 kV) is applied. The wire is covered by the charging case The material of the case is a stainless steel that is not easily oxidized. Also, a grid is extended and set between the wire and the photoconductor, on which grid a voltage of approximately −0.6 kV is applied. The grid is provided by cutting a stainless steel plate (the thickness of the plate being 0.1 mm) into a mesh-shape.

In the corona charging device in FIG. 2, the charging of the photoconductor is performed as follows. In the neighborhood of the extended and set wire, a strong electric field is formed and dielectric breakdown of air occurs, to generate ions. A part of the ions are moved due to the electric field between the wire and the photoconductor, and the surface of the photoconductor is charged. Since the charging of the photoconductor is continued until the electric potential of the surface of the photoconductor becomes approximately equal to the electric potential applied on the grid, the electric potential of the surface of the photoconductor can be controlled by the electric potential applied on the grid.

There is also a corona charging device in which a sawtooth-shaped electrode is used as a discharge electrode, other than the corona charging device using a wire (Japanese Laid-Open Patent Application Nos. 8-20210 and 6-301286).

FIG. 3 is a schematic diagram of one example of the corona charging device using the sawtooth-shaped electrode. The sawtooth-shaped electrode has a shape as shown in FIG. 4, which electrode is made from a stainless steel plate with the thickness of 0.1 mm, wherein the pitch of the sawteeth is 3 mm. The sawtooth-shaped electrode is fixed on a supporting member as shown in FIG. 3, on which a high voltage (−5 kV) is applied by a power supply. Also, in the corona charging device using a sawtooth-shaped electrode, the electrode is covered by a charging case made from stainless steel and a grid is provided between the sawtooth-shaped electrode and the photoconductor, similar to the corona charging device using a wire. Also, charging of the photoconductor by the corona charging device using a sawtooth-shaped electrode is the same as the case of the the corona charging device-using a wire, and corona discharge occurs near the vertexes of the sawtooth-shaped electrode. In addition to the above those corona charging devices, a corona charging device in which a discharge electrode is a needle-shaped (pin-shaped) electrode has been devised.

The corona charging device using the sawtooth-shaped electrode has the advantages of more compact size and lower ozone generation compared to the case of the one using a wire. Since corona discharge by the sawtooth-shaped electrode creates an electric field stronger than electric field created by the wire (the flux of ions directed toward the grid or the photoconductor in the case of using the sawtooth-shaped electrode is lager than in the case of using the wire), the width of the charging device (or the width of an opening of the charging case at the side of the photoconductor) can be reduced. This is important for minituraization of the entire image formation apparatus. Also, since the corona discharge creates the stronger electric field and the flux of ions is larger, charging efficiency of the photoconductor is increased and the electric current flow through the corona charging device can be decreased. Consequently, the generation quantity of ozone is also reduced.

As a charging device for the image formation apparatus, there is a so-called contact charging device in addition to the above those corona charging device. The contact charging device can attenuate the problems of the corona charging device, that is, 1. much generated ozone
2. high applied voltage (5 through 7-kV).

Accordingly, the contact charging device has been widely employed as a charging device for a low speed or middle speed electrophotographic process image formation apparatus.

The contact charging device performs charging of the photoconductor by contacting a charging member with the photoconductor being a charged body (referred to as simply a photoconductor, below) and applying a voltage to the charging member. FIG. 5 is a sectional diagram of one example of the conventional contact charging device. A charging member 2 is roller-shaped with a diameter of 5 through 20 mm and a length of approximately 300 mm, on which an elastic layer 2*a* is formed on a conductor 2*b*. A photoconductor drum 1 has a diameter of 30 through 80 mm and a length of approximately 300 mm, on which a photoconductor 1*a* is formed on a conductor 1*b*. The charging member contacts the rotating photoconductor drum, and rotates following the rotation of the photoconductor. The elastic layer of the charging member is made from a material with the resistivity of $10^7$ through $10^9$ Ωcm. Then, a surface protecting layer with the thickness of approximately 10 through 20 μm may be formed on the surface of the charging member (the surface of the elastic layer). A voltage is applied on the charging member by a power supply 3 to perform charging of the photoconductor. The applied voltage is a direct current voltage of −1.5 through −2.0 kV. Due to such configuration, the photoconductor can be uniformely charged at −500 through −800 V by the contact charging device.

In the light-exposure means in the image formation apparatus using the electrophotographic process, light modulation in a so-called LD (laser diode) is performed corresponding to an output image. Laser light emitted from the LD is imaged onto the photoconductor through a so-called collimator lens, an aperture, a cylindrical lens, a polygon mirror, and an f-θ lens. The polygon mirror is a rotatable polyhedral mirror and laser light scans the photoconductor due to rotation of the polygon mirror. Accordingly, the photoconductor is exposed to laser light so that a latent image corresponding to a desired image can be formed on the photoconductor.

For the photoconductor of the image formation apparatus using an electrophotographic process, a so-called organic photoconductor has become popular. In the organic photoconductor, a lamination layer-type is popular, in which a so-called generating layer and a charge transfer layer are laminated on a conductive substrate so as to give a durability to the charge transfer layer. Furthermore, a protecting layer may be laminated on lamination layer-type organic photoconductors recently.

Moreover, since a demand for color printers have been advancing in recent years, it has become important to make the image quality higher.

In the image formation apparatus using an electrophotographic process, it is known that reducing the thickness of the photoconductor film is needed in order that the electric field for development can reproduce an image with higher spatial frequency ("Fundamentals and Application of Electrophotographic Processes", Corona Publishing Co., Ltd., pp. 150-151).

However, as shown in a conventional technique (Japanese Laid-Open Patent Application 11-95462), when the thickness of the photoconductor film is reduced, the problem is that the durability of the film against wear and flaws due to cleaning is reduced and deterioration of the photoconductor film is accelerated by repetition of the charging process and light-exposure process. In the conventional lamination layer-type organic photoconductor, polycarbonate is generally used as a binder layer in the charge transfer layer, wherein the thickness of the charge transfer (CT) layer is generally set at approximately 20 through 30 μm due to the above-mentioned problem Accordingly, a CT layer with a thickness of 20 through 30 μm is used in actuality so as to maintain the high durability of the photoconductor film preferentially but sacrifice image quality.

According to an experiment performed by the inventors of the present invention, when a photoconductor having a charge transfer layer with the thickness of approximately 20 through 30 μm was employed, it was obvious that an image having a high spatial frequency, such as a so-called isolated 1 dot or 1 dot line image, could not be reproduced. Accordingly, a so-called bit-mapped image, etc. cannot be output without complex image processing by the image formation apparatus that does not fully reproduce the isolated 1 dot or 1 dot line image.

When the resolution of the image is reduced to 600 dpi or 400 dpi, the isolated 1 dot or 1 dot line image can be reproduced, but a coarse image is obtained due to the larger isolated 1 dot or 1 dot line. Also, reduction in resolution of an image including an oblique line causes jaggies, consequently degrading image quality. Furthermore, the problem for character images is that a resolution of equal to or more than 1200 dpi is required so as to discriminate between various fonts of the characters, and there has been the problem of simultaneously satisfying such high resolution of an image and reproduction of the isolated 1 dot or 1 dot line image.

Also, according to an experiment performed by the inventors of the present invention, when a photoconductor having a charge transfer layer with a thickness of approximately 20 through 30 μm was employed and image data subjected to a halftone processing at a line frequency of equal to or more than 200 lpi were written, the problem was that the output image had low tone so that an acceptable image could not be obtained for an image that requires tone representation at the same level as that of a photograph image. (On the other hand, when a halftone processing at a line frequency of less than 200 lpi is applied, the problem is that tone is maintained to be better but the texture of dithers is visible and a fine-grained image cannot be obtained.)

Moreover, in the condition of a worse tone (in this case of applying halftone processing with 200 lpi), the problem was that so-called banding was quick to occur and only a very noisy image was obtained.

SUMMARY OF THE INVENTION

It is a general object of the present invention to provide an image formation apparatus that allows the quality of an image to be higher, to obtain high quality images stably at repeated use, and avoid the aforementioned problems even if a charge transfer layer is thick.

The object of the present invention described above is achieved by an image formation apparatus using an electrophotographic process including a photoconductor, a charging part that charges a surface of the photocounductor at a desired electric potential, and a light-writing part that performs light-writing to form a latent image on the surface of the photoconductor, wherein the photoconductor includes a conductive support, a charge generating layer containing a charge generating material, and a charge transfer layer containing a charge transfer material, the charge generating layer and the charge transfer layer being laminated on the conductive support, and an ionization potential of the charge generating material Ip(CG) and an ionization potential of the charge transfer material Ip(CT) satisfy relationship (T);

$$Ip(CG) \geqq Ip(CT) \quad \text{(I)}$$

Preferably, the light-writing part may be a laser light beam of which the diameter is equal to or less than 35 μm.

Also, the image formation apparatus has a resolution for light-writing of equal to or more than 1200 dpi.

Alternatively, the image formation apparatus further includes an image processing part that applies halftone processing at a line frequency of equal to or more than 200 lpi to an input image, wherein the light-writing is performed based on image data formed by applying the halftone processing to the input image.

The charge generating material is preferably an asymmetric disazo pigment represented by the general formula (II), $$Cp_1\text{-N}{=}\text{N-A-N}{=}\text{N-}Cp_2 \quad \text{(II);}$$

wherein A is a divalent group that contains carbon atoms at both terminals thereof, each of the carbon atoms bonds to a nitrogen atom of one of the azo groups, and $Cp_1$ and $Cp_2$ are coupler groups that are different from each other.

More preferably, the asymmetric azo pigment is a compound represented by the general formula (III), (III)

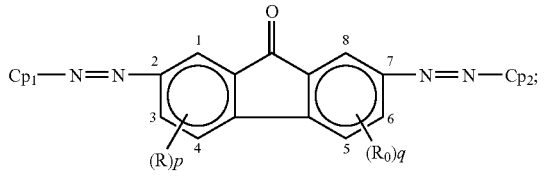

wherein each of R and $R_0$ is one of a hydrogen atom, a halogen atom, a substituted or non-substituted alkyl group, a substituted or non-substituted alkoxy group, a nitro group, a cyano group, a hydroxyl group, and a substituted or non-substituted amino group; p and q are integers of 0 through 3; and $Cp_1$ and $Cp_2$ are coupler groups that are different from each other.

Furthermore, it is preferable that the thickness of the charge transfer layer be equal to or less than 20 μm.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

An electrophotographic photoconductor used in the present invention will be illustrated with reference to the drawings below.

Figure 1:
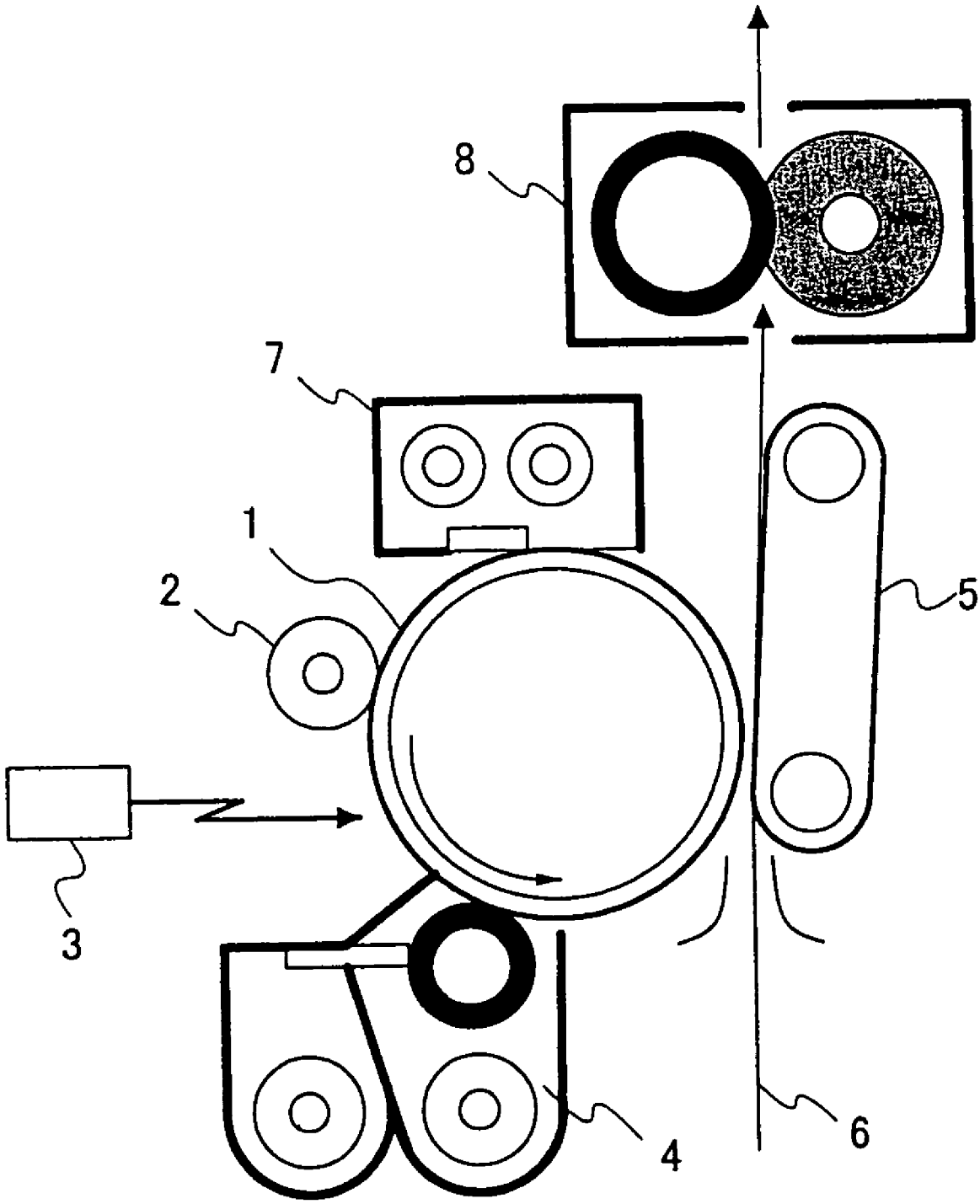
CONVENTIONAL ART FIG.1
FIG. 1 is a schematic diagram showing a conventional image formation apparatus.
Figure 2:
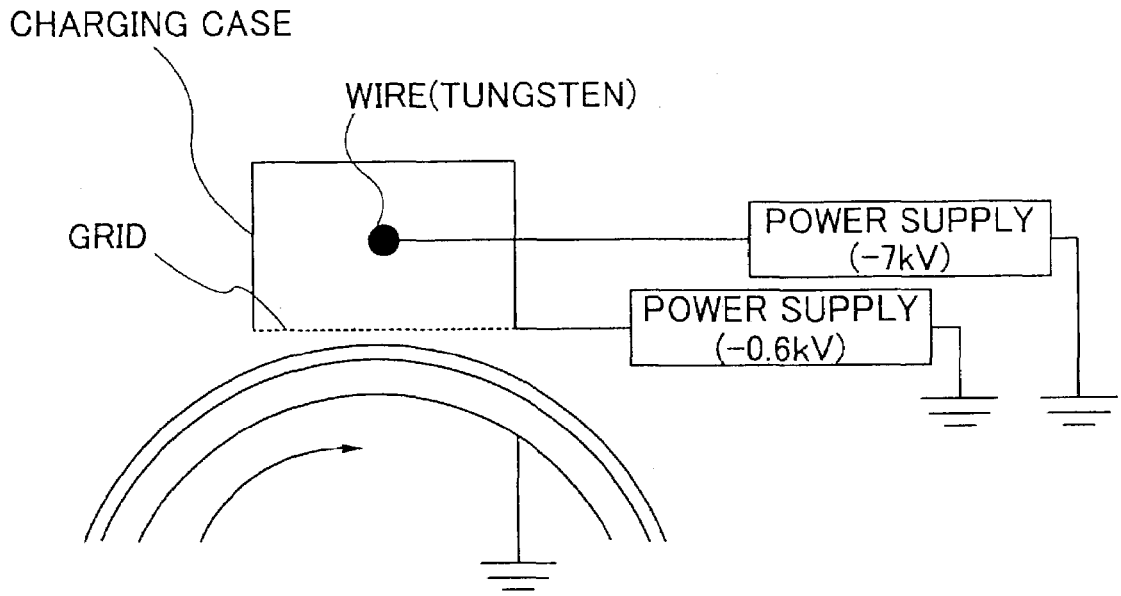
FIG. 2 is a schematic diagram showing a corona charging device using a wire.
Figure 3:
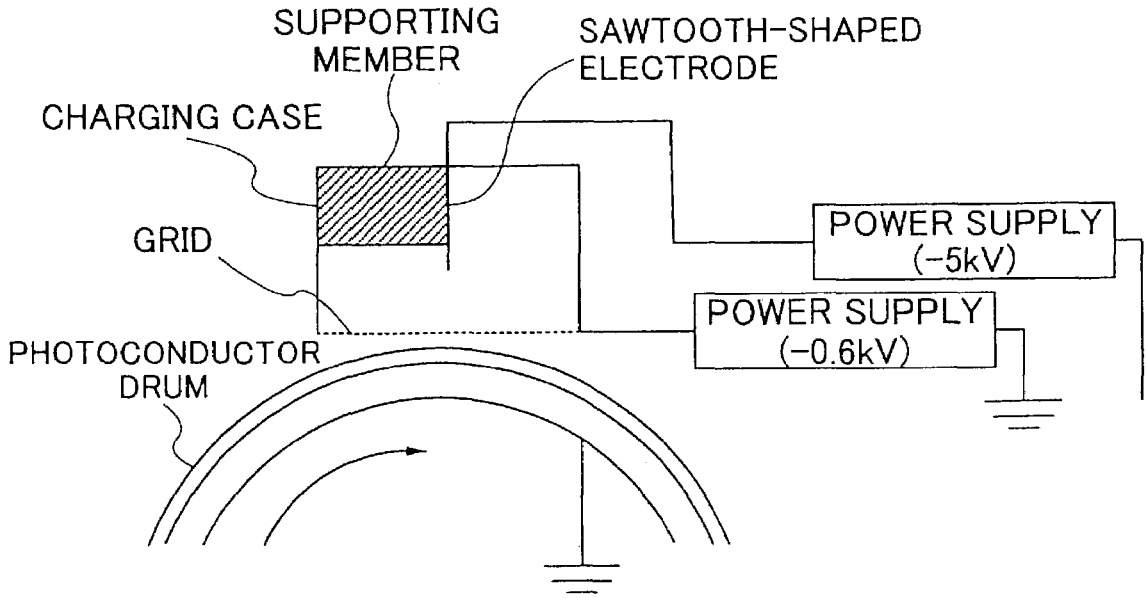
FIG. 3 is a schematic diagram showing a corona charging device using a sawtooth electrode.
Figure 4:
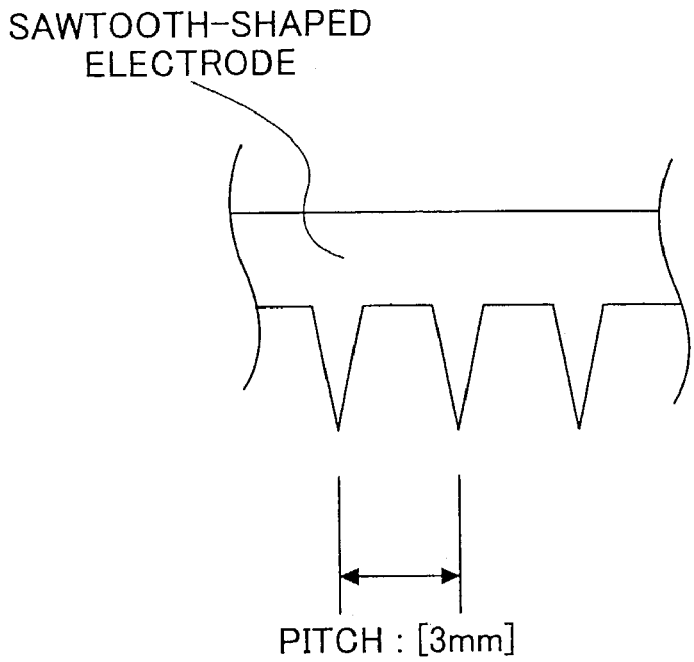
FIG. 4 is a schematic diagram showing a sawtooth electrode.
Figure 5:
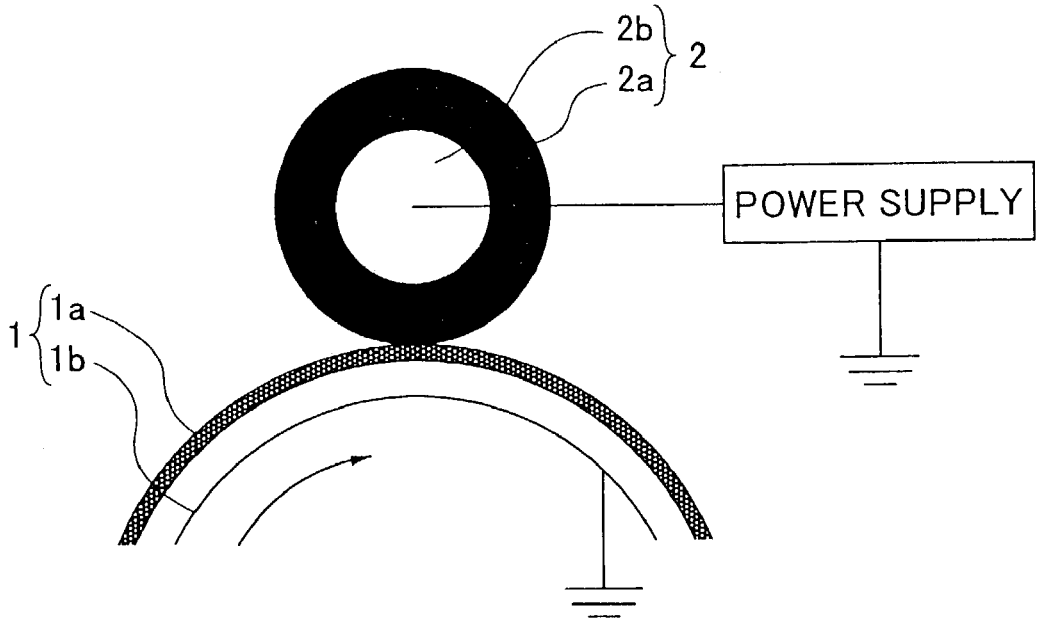
FIG. 5 is a schematic diagram showing a contact charging device.
Figure 6:
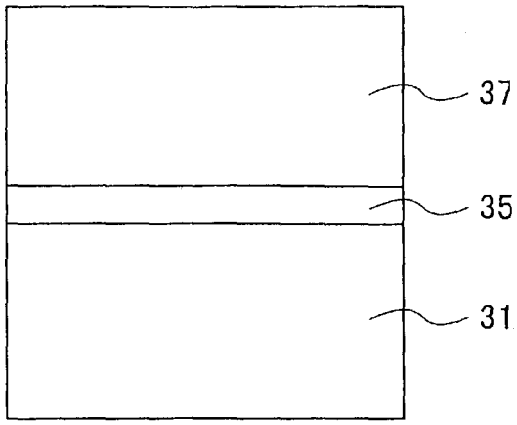
FIG. 6 is a diagram showing a structure of a photoconductor provided by laminating a charge generating layer and a charge transfer layer on a conductive support.

FIG. 6 shows the structure of a photoconductor provided by laminating a charge generating layer 35 based on a charge generating material and a charge transfer layer 37 based on a charge transfer material on a conductive support 31.

Figure 7:
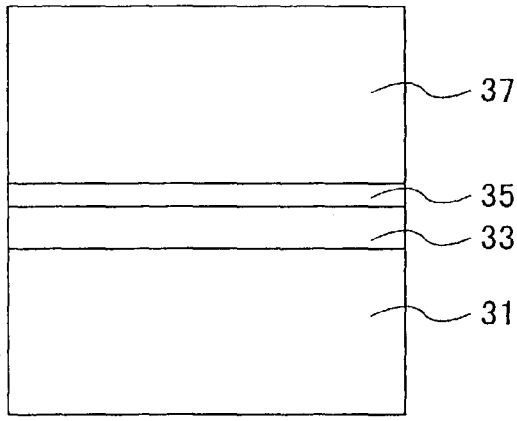
FIG. 7 is a diagram showing a structure of a photoconductor including a middle layer between a generating layer and a conductive support.

FIG. 7 shows the structure of a photoconductor further including a middle layer 33 between the charge generating layer 35 and the conductive support 31 shown in FIG. 6.

Figure 8:
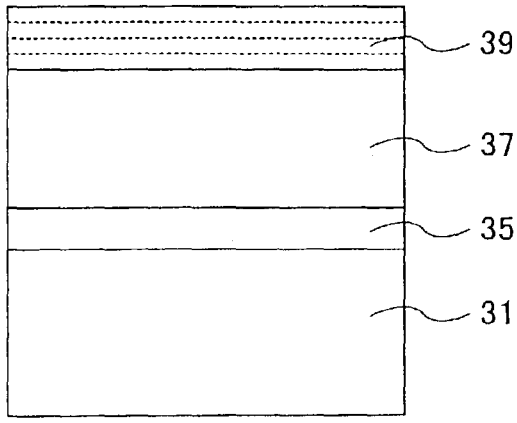
FIG. 8 is a diagram showing a structure of a photoconductor provided by laminating a charge generating layer, a charge transfer layer, and a protecting layer on a conductive support.

FIG. 8 shows the structure of a photoconductor in which the charge generating layer 35 based on a charge generating material (CGM) and the charge transfer layer 37 based on a charge transfer material (CTM) are laminated on the conductive support 31, wherein a protecting layer 39 containing a filler and a dispersing agent is formed on the charge transfer layer 37.

The conductive support 31 is formed by coating a material indicating a volume resistance (resistivity) of $10^{10}$ Ωcm, which may be selected from the group consisting of metals such as aluminum, nickel, chromium, nichrome, copper, gold, silver and platinum, and metal oxides such as tin oxide and indium oxide, to a plastic film or cylinder or paper using vapor deposition or sputtering. Also, the conductive support 31 may be a tube that is formed by surface treatment of an original tube using cutting, super finishing or polishing, after a plate or plates made from aluminum, aluminum alloy, nickel and stainless steel is/are formed into the original tube using extrusion or protrusion. Furthermore, an endless nickel belt and an endless stainnless belt, disclosed in Japanese Laid-Open Patent Application No. 52-36016, can be also employed as the conductive support 31.

Moreover, the conductive support 31 according to the present invention may be provided by coating a suitable binding resin in which conductive powder is dispersed, onto the above-mentioned support. As for the conductive powder, given are powder of a metal such as aluminum, nickel, iron, nichrome, copper, zinc and silver, powder of a metal oxide such as conductive tin oxide and ITO, carbon black, and acetylene black. As the binding resin, given are thermoplastic resin, thermosetting resin and photo-setting resin such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyallylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. The conductive layer is provided by application of dispersed system of the conductive powder and the binding resin in a suitable solvent such as tetrahydrofuran, dichloromethane, methyl ethyl ketone, and toluene.

Moreover, as the conductive support 31 according to the present invention, a conductive layer made from a thermal shrinkage tube containing the above-mentioned conductive powder in a material such as polyvinyl chloride, polypropylene, polyester, polystyrene, polyvinylidene chloride, polyethylene, chlorinated rubber and Teflone (registered trademark) formed on a suitable cyrindrical substarate, can be used preferably.

Next, the charge generating layer 35 is a layer based on the charge generating material, and can be formed by applying a dispersed system or solution of the charge generating material and a binding resin in a suitable solvent, onto the conductive support or an underlying layer, and subsequently drying the applied dispersed system or solution.

For the charge generating layer 35, any publicly known charge generating material that satisfies the following relationship (I) between the ionization potential of the charge generating material Ip(CG) and the ionization potential of the charge transfer material contained in the charge transfer layer Ip(CT);

$$Ip(CG) \geqq Ip(CT) \quad \text{(I)}$$

has to be employed, according to the present invention.

The reason why the CGM and CTM satisfying the above relationship (I) is preferred for the present invention is as follows. In the lamination layer-type photoconductor provided by laminating at least the charge generating layer and the charge transfer layer on the conductive support, carriers generated by light energy in the charge generating layer are injected into the charge transfer layer through the interface between the charge generating layer and the charge transfer layer. The injected carriers move inside the charge transfer layer and neutralize the surface charge of the photoconductor so that a latent image is formed. Since the injection of the carriers is influenced by both the charge generating layer and the charge transfer layer, the combination of the charge generating material with the charge transfer material has been selected properly and empirically in conventional photoconductor designs.

In the case of Ip(CG)<Ip(CT), indicated as outside of the scope of the present invention, a barrier for carrier injection is present at the interface so that carriers are not smoothly injected from the charge generating layer into the charge transfer layer, causing residence of the carriers at the interface. In this case, it is seen that spatial charge is distributed inside the photoconductor and carriers are diffused by an electric field originating from the resident carriers. Thus, it is considered that the latent image would be degraded. Accordingly, when a photoconductor including the charge generating material and the charge transfer material that satisfy the relationship (I) according to the present invention is used, a high quality image can be obtained without an increase of the diameter of a LD dot even in the case of using a high quality electrophotographic process in which light-writing means includes a laser light beam with a diameter equal to or less than 35 μm and a resolution for the light-writing equal to or more than 1200 dpi.

Herein, the term "ionization potential" used in the present invention means the energy quantity required to ionize one electron from a ground state of a material. The ionization potentials may be measured by the vacuum ultraviolet absorption method, the electron impact method, the photoionization method, and photoelectron spectroscopy. In the present invention, an apparatus for measuring a spectrum of photoelectrons emitted by irradiation of ultraviolet rays in the atmosphere (surface analyzer AC-1 made by Riken Keiki Co., Ltd.) was used. The ionization potentials were obtained by irradiating ultraviolet rays at a certain wavelength extracted by using a monochrometer onto samples with a variation of the energy of the ultraviolet rays, and measuring lowest energies at which emission of photoelectrons due to the photoelectric effect started.

As the charge generating material used in the present invention, phthalocyanine-based pigments such as titanyl phthalocyanine, vanadyl phthalocyanine, copper phthalocyanine, hydroxygalium phthalocyanine and non-metal phthalocyanine, azo pigments such as a monoazo pigment, disazo pigments, asymmetric disazo pigments and trisazopigments, perylene-based pigments, perynone-based pigments, indigo pigments, pyrolopyrrole pigments, anthraquinone pigments, quinacridone-based pigments, quinone-based condensed polycyclic compounds, and squarium pigments can be used. However, among those pigments, it is preferable that asymmetric disazo pigments that are very highly sensitive to light represented by the following general formula (II), $$Cp_1\text{-N}{=}\text{N-A-N}{=}\text{N-}Cp_2 \quad \text{(II);}$$

be used, wherein A is a divalent group of which a terminal carbon atom bonds to a nitrogen atom of one of the azo groups, and $Cp_1$ and $Cp_2$ are coupler groups of which structures are different from each other. The asymmetric disazo pigments can be obtained either by reacting a corresponding diazonium salt with couplers corresponding to $Cp_1$ and $Cp_2$ sequentially at two stages or by isolating a diazonium salt compound obtained via a coupling reaction of a corresponding diazonium salt with one coupler $Cp_1$ or $Cp_2$ and reacting the diazonium salt compound with the other coupler. Examples of A, $Cp_1$ and $Cp_2$ in the asymmetric disazo pigments will be shown below.

Examples of the divalent group A are:
A-1
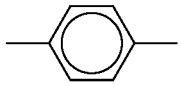
A-2
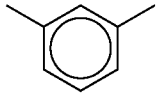
A-3
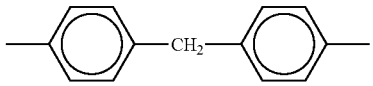
A-4
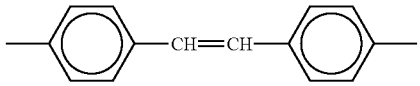
A-5
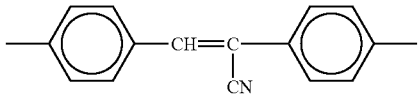
A-6
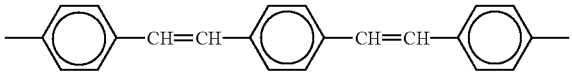
A-7
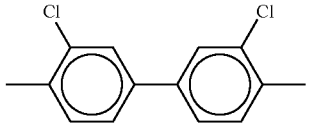
A-8
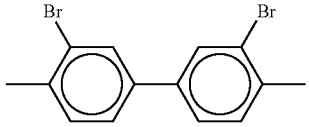
A-9
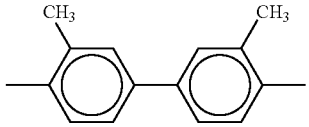
A-10
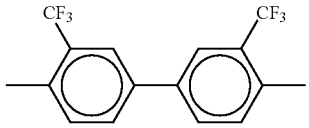
A-11
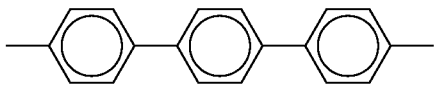
-continued
A-12
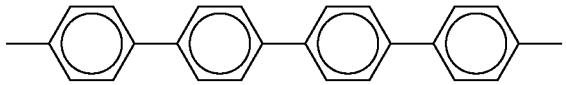
A-13
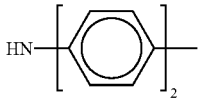
A-14
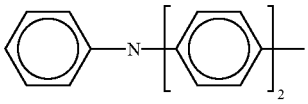
A-15
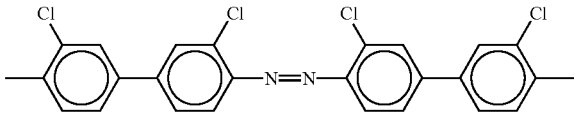
A-16
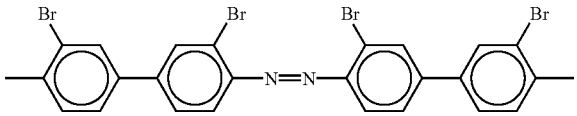
A-17
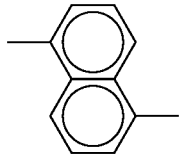
A-18
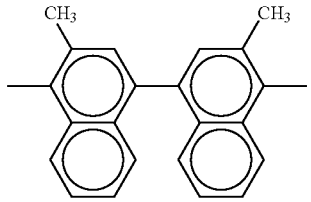
A-19
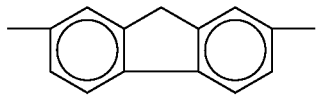
A-20
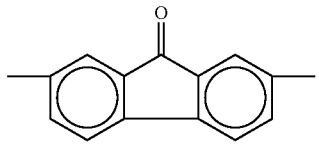
A-21
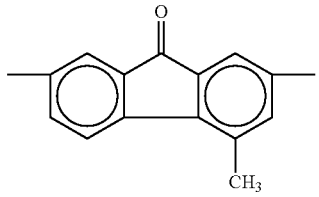

-continued

A-22

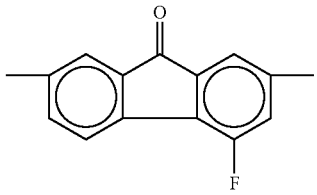

A-23

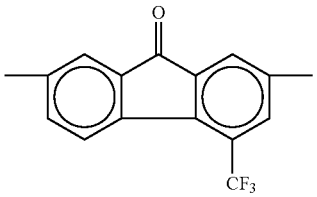

A-24

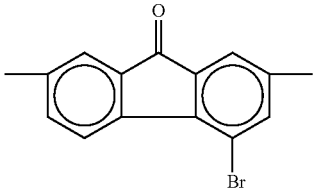

A-25

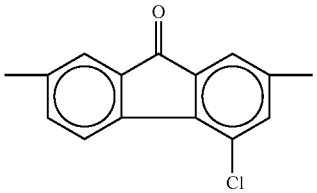

A-26

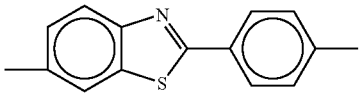

A-27

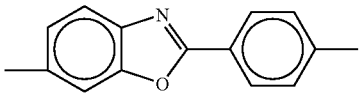

A-28

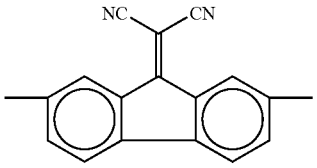

A-29

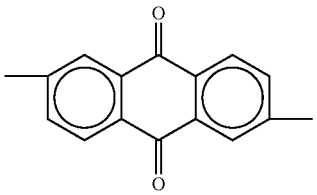

A-30

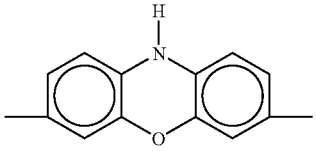

-continued

A-31

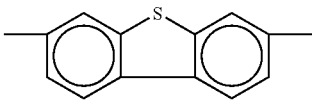

A-32

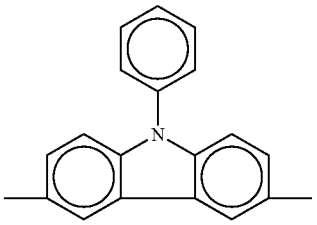

A-33

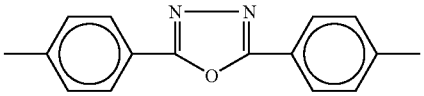

A-34

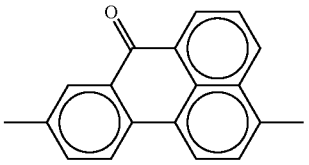

Examples of the coupler $Cp_1$ or $Cp_2$ are:

An example of $Cp_1$ or $Cp_2$ (C1)

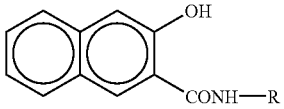

| No. | R |
|---|---|
| 1 | Phenyl |
| 2 | 2-chlorophenyl |
| 3 | 3-chlorophenyl |
| 4 | 4-chlorophenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-pyrazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

An example of $Cp_1$ or $Cp_2$ (C2)

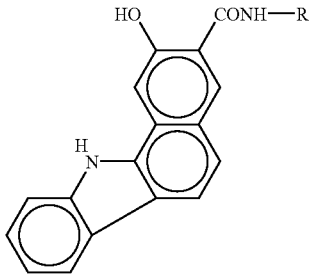

| No. | R |
|---|---|
| 1 | Phenyl |
| 2 | 2-chlorophenyl |
| 3 | 3-chlorophenyl |
| 4 | 4-chlorophenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-pyrazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

An example of $Cp_1$ or $Cp_2$ (C3)

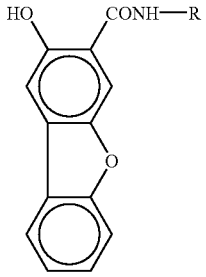

| No. | R |
|---|---|
| 1 | Phenyl |
| 2 | 2-chlorophenyl |
| 3 | 3-chlorophenyl |
| 4 | 4-chlorophenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |

-continued

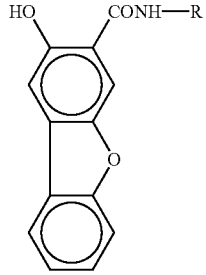

| No. | R |
|---|---|
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-pyrazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

An example of $Cp_1$ or $Cp_2$ (C4)

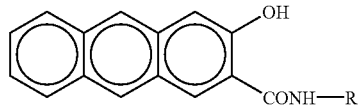

| No. | R |
|---|---|
| 1 | Phenyl |
| 2 | 2-chlorophenyl |
| 3 | 3-chlorophenyl |
| 4 | 4-chlorophenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-pyrazolyl |
| 24 | 2-thiazolyl |
| 25 | 4-carboxyl-2-thiazolyl |
| 26 | 2-pyridyl |

-continued

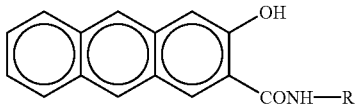

| No. | R |
|---|---|
| 27 | 2-pyrimidinyl |
| 28 | 2-carbazolyl |
| 29 | 2-quinolyl |

An example of $Cp_1$ or $Cp_2$ (C5)

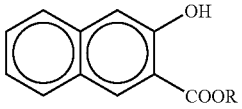

| No. | R |
|---|---|
| 1 | Methyl |
| 2 | Ethyl |
| 3 | Propyl |
| 4 | Isopropyl |
| 5 | Butyl |
| 6 | Isobutyl |
| 7 | sec-butyl |
| 8 | tert-butyl |
| 9 | pentyl |
| 10 | isoamyl |
| 11 | hexyl |
| 12 | heptyl |
| 13 | octyl |
| 14 | capryl |
| 15 | nonyl |
| 16 | decyl |
| 17 | undecyl |
| 18 | lauryl |
| 19 | tridecyl |
| 20 | pentadecyl |

An example of $Cp_1$ or $Cp_2$ (C6)

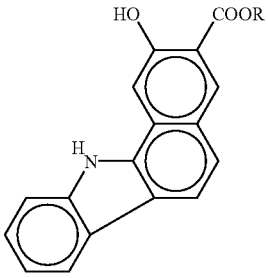

| No. | R |
|---|---|
| 1 | Methyl |
| 2 | Ethyl |
| 3 | Propyl |
| 4 | Isopropyl |
| 5 | Butyl |
| 6 | Isobutyl |
| 7 | sec-butyl |
| 8 | tert-butyl |
| 9 | pentyl |
| 10 | isoamyl |

-continued

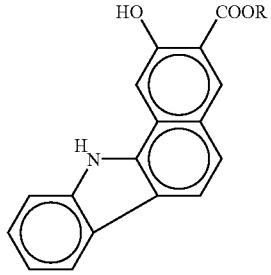

| No. | R |
|---|---|
| 11 | Hexyl |
| 12 | Heptyl |
| 13 | Octyl |
| 14 | Capryl |
| 15 | Nonyl |
| 16 | Decyl |
| 17 | Undecyl |
| 18 | Lauryl |
| 19 | Tridecyl |
| 20 | Pentadecyl |

Examples of $Cp_1$ or $Cp_2$ (C7-1, C7-2, C-8)

(C7-1)

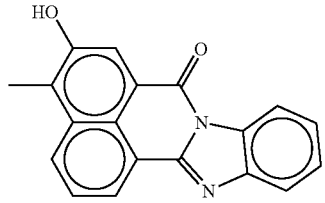

(C7-2)

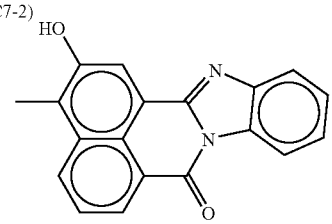

(C7-3)

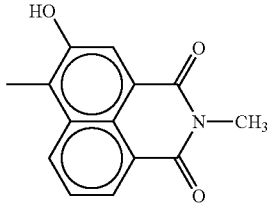

Among the asymmetric disazo pigments, particularly, compounds containing a central skeleton of fluorenone represented by A-20 through A-25 can be employed preferably in the present invention, which compounds are represented by the following general formula (III), (III)

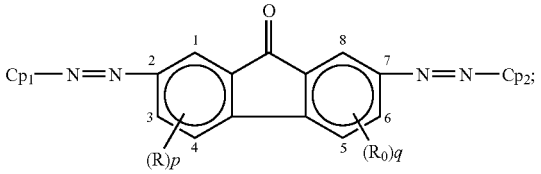

wherein each of R and $R_0$ is one of a hydrogen atom, a halogen atom, a substituted or non-substituted alkyl group, a substituted or non-substituted alkoxy group, a nitro group, a cyano group, a hydroxyl group, and a substituted or non-substituted amino group; p and q are integers of 0 through 3; and $Cp_1$ and $Cp_2$ are coupler groups that are different from each other.

Examples of the asymmetric disazo pigments represented by the general formula (III) will be shown below, but the charge generating material in the present invention is not limited to the pigments.

(I)-1

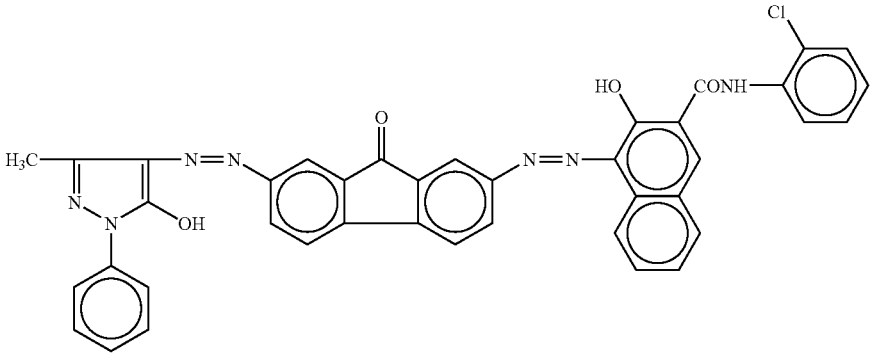

(I)-2

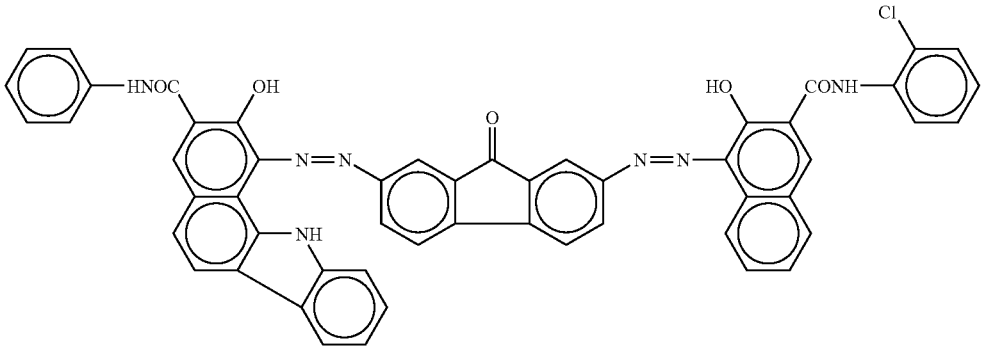

(I)-3

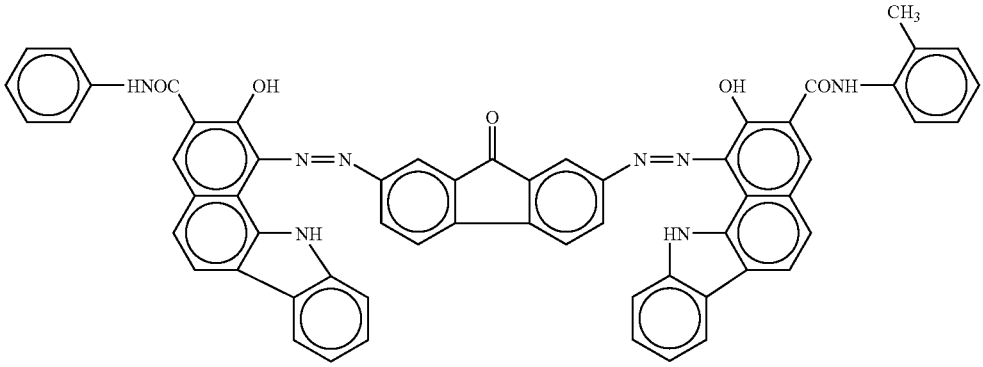

-continued
(I)-4
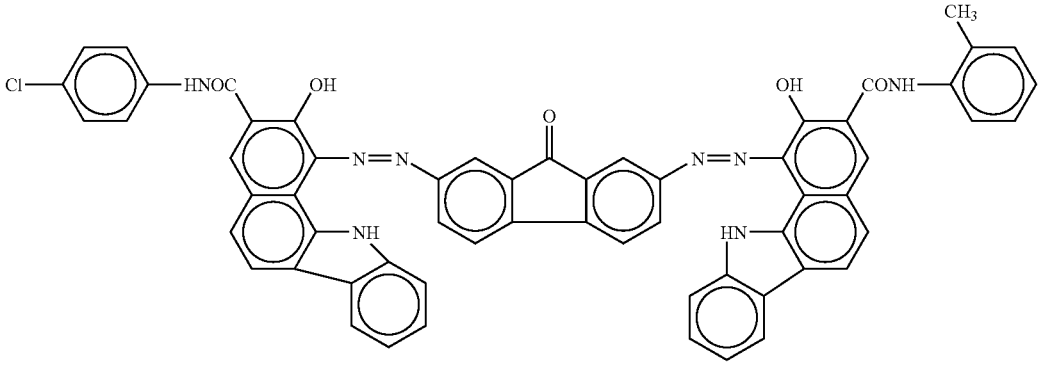
(I)-5
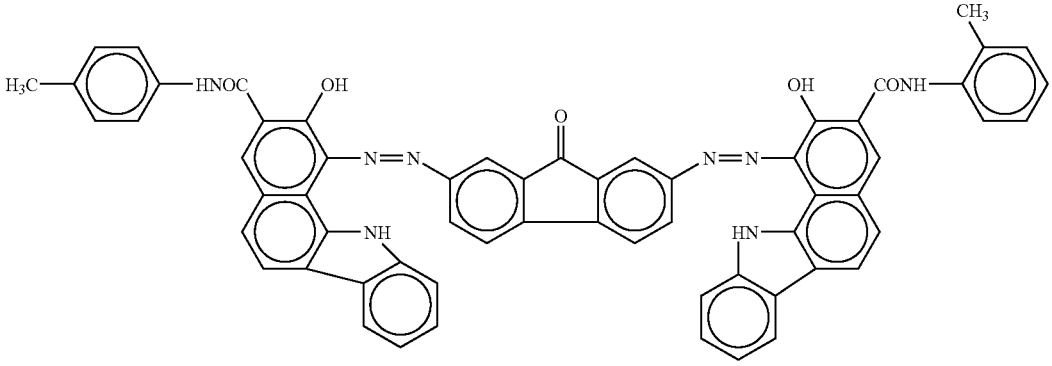
(I)-6
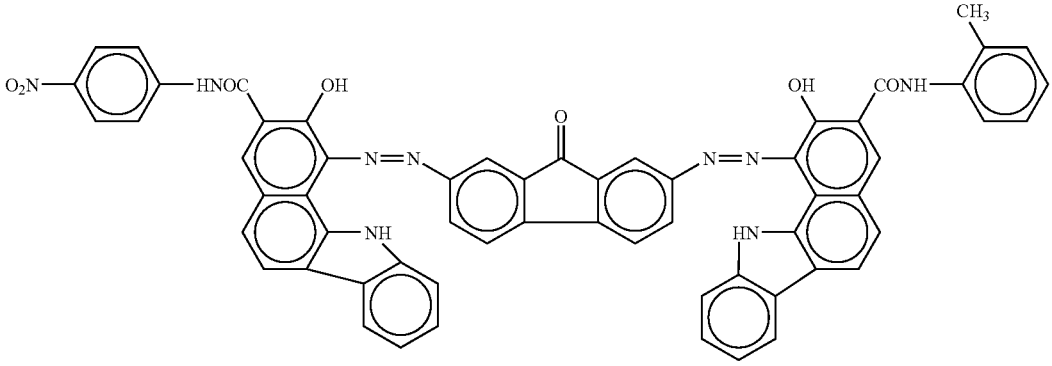
(I)-7
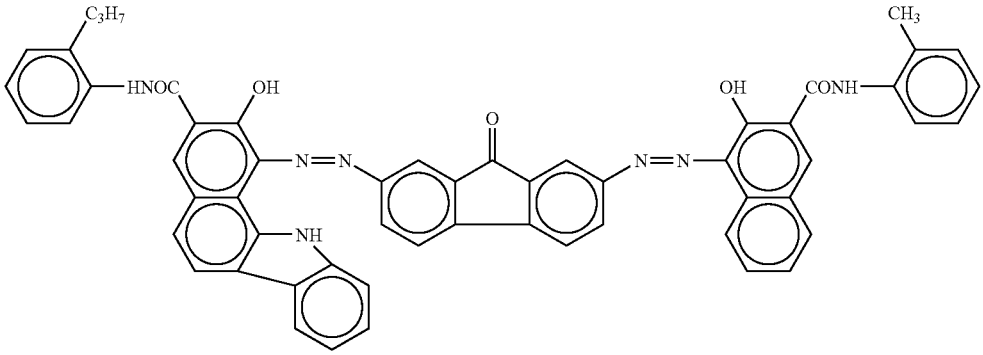

-continued
(I)-8
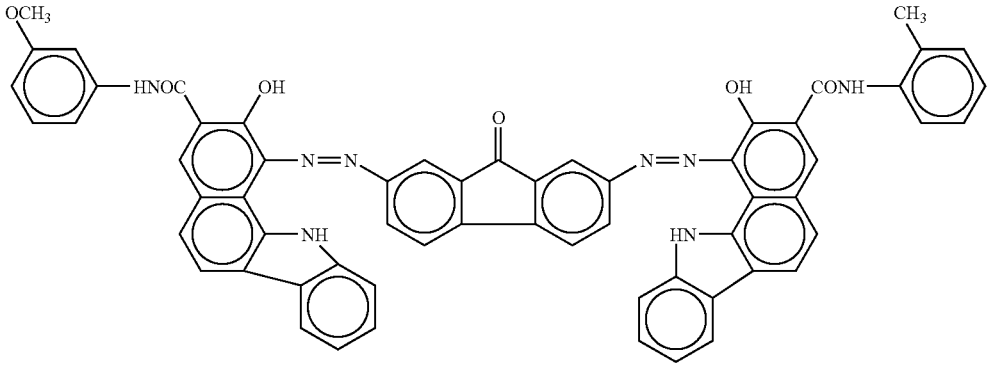
(I)-9
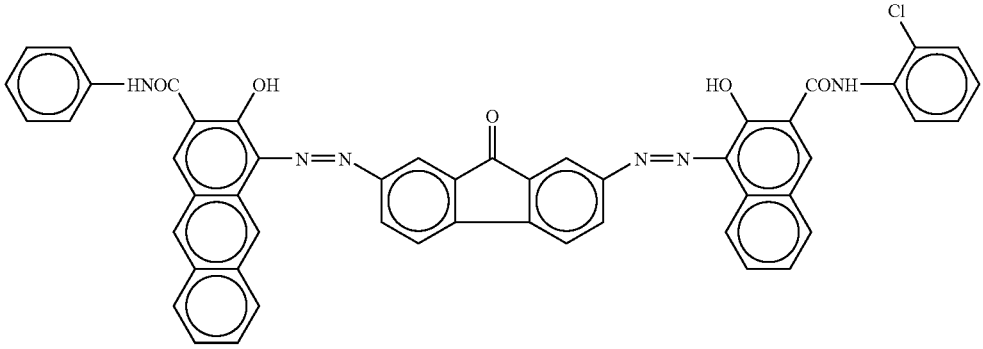
(I)-10
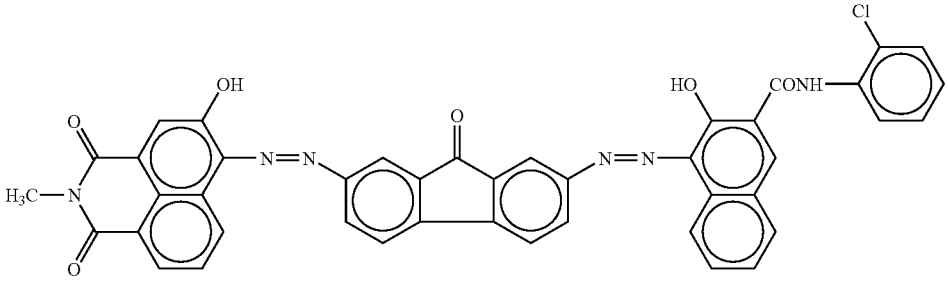
(I)-11
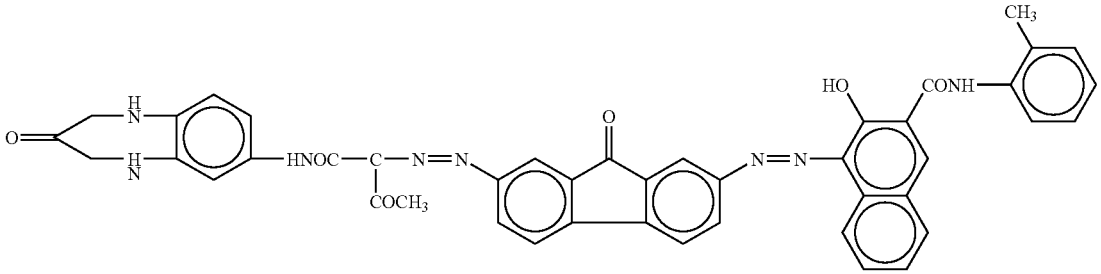

-continued
(I)-12
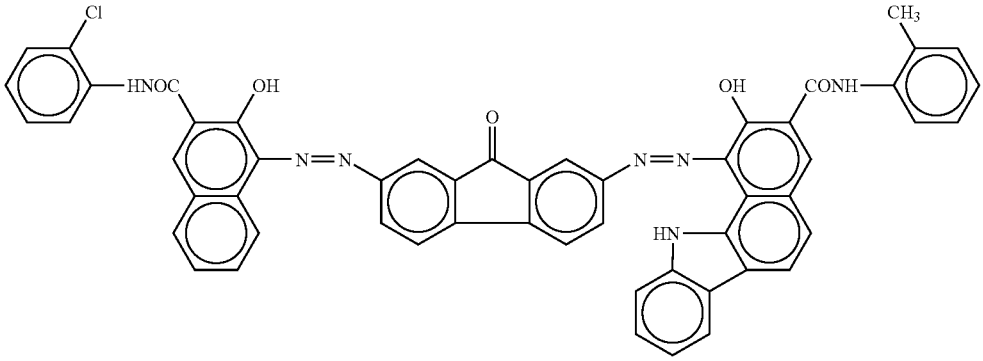
(I)-13
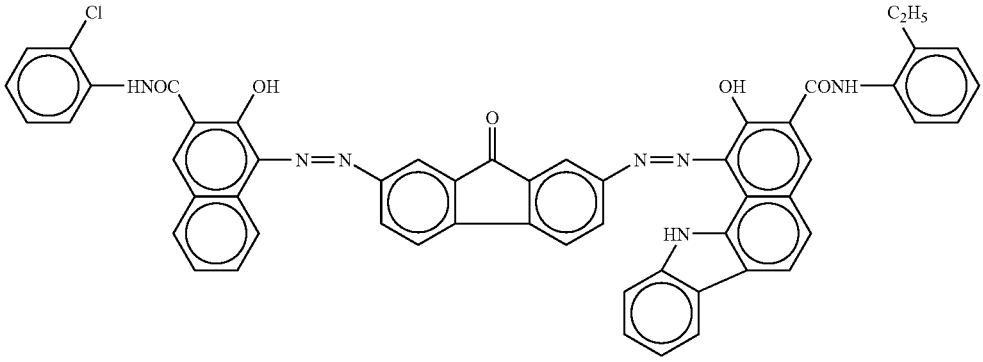
(I)-14
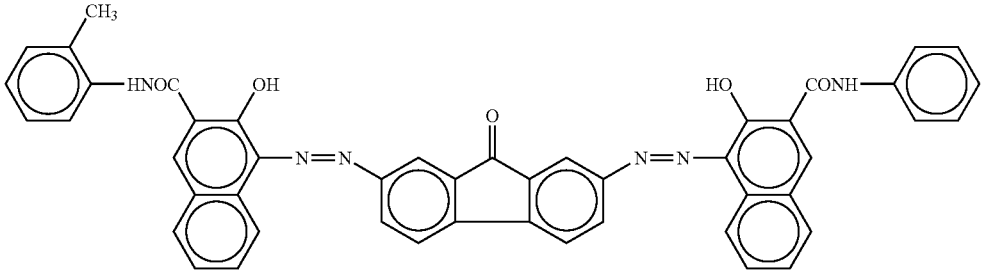
(I)-15
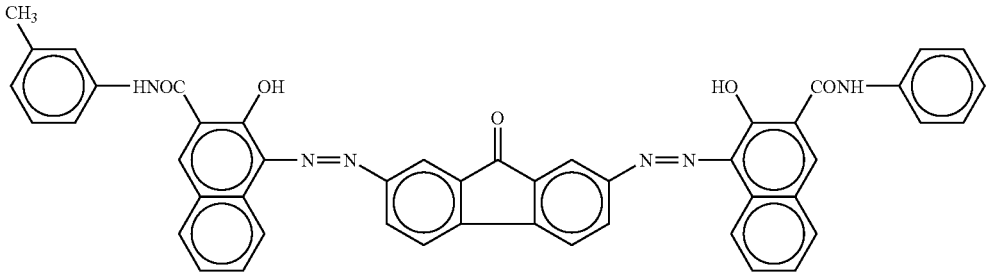
(I)-16
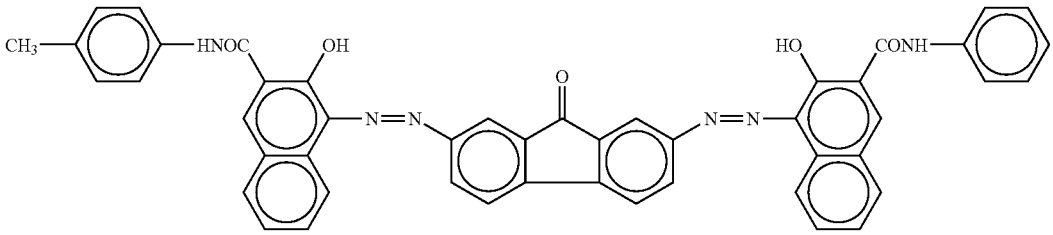

-continued
(I)-17
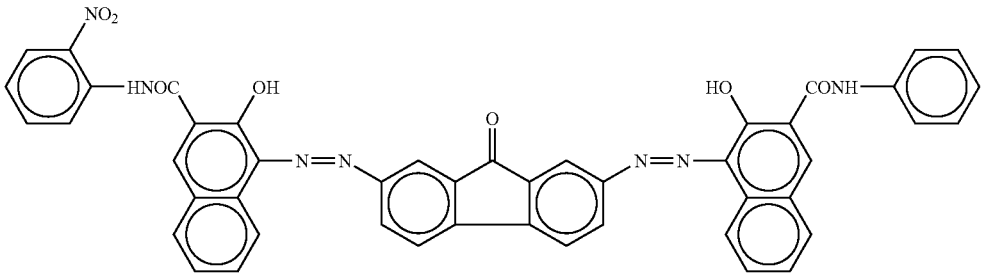
(I)-18
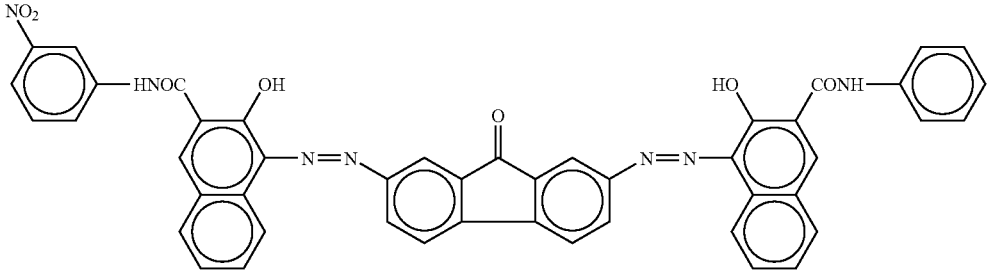
(I)-19
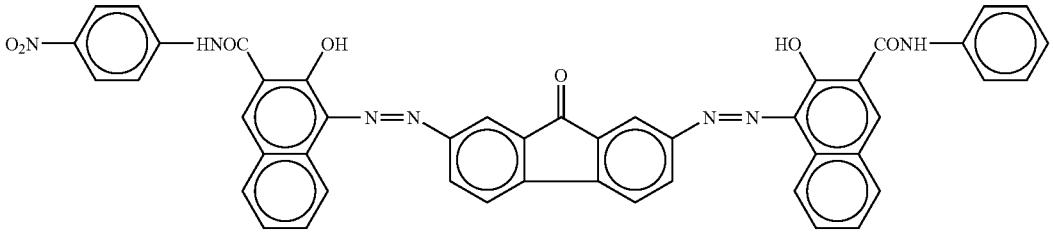
(I)-20
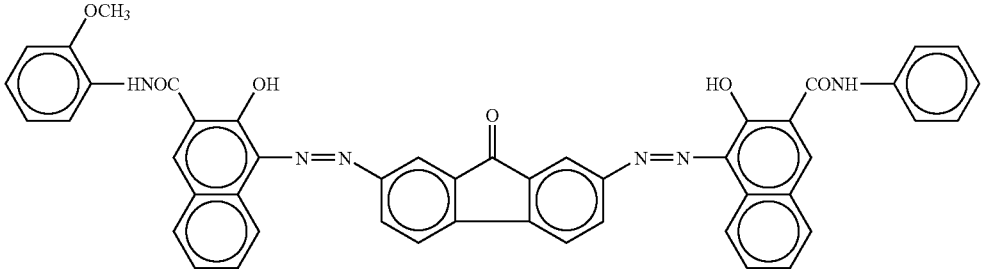
(I)-21
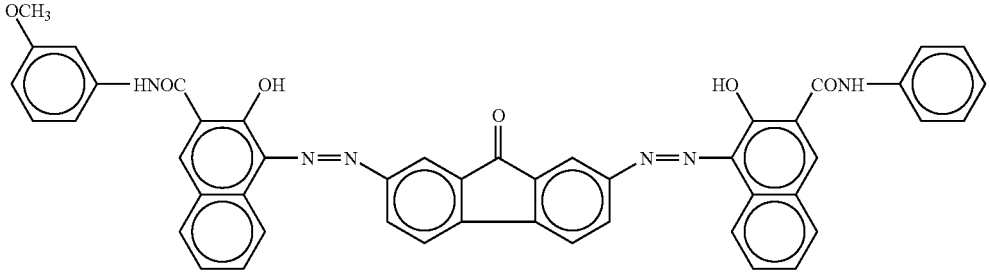
(I)-22
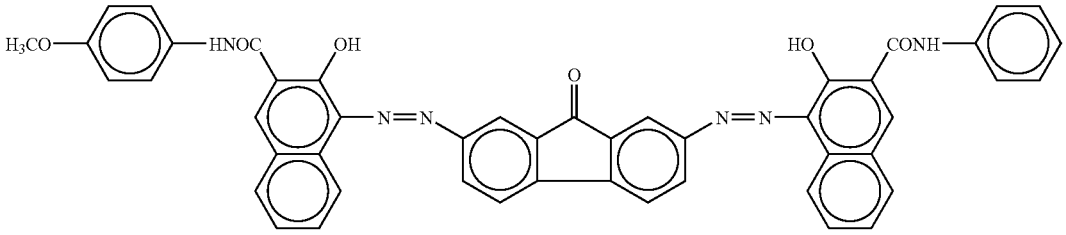

-continued
(I)-23
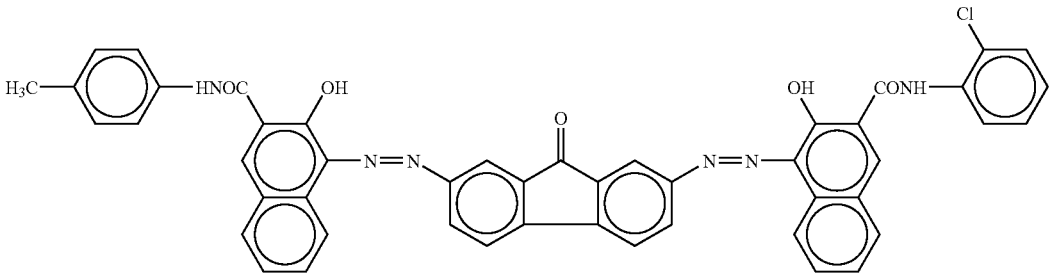
(I)-24
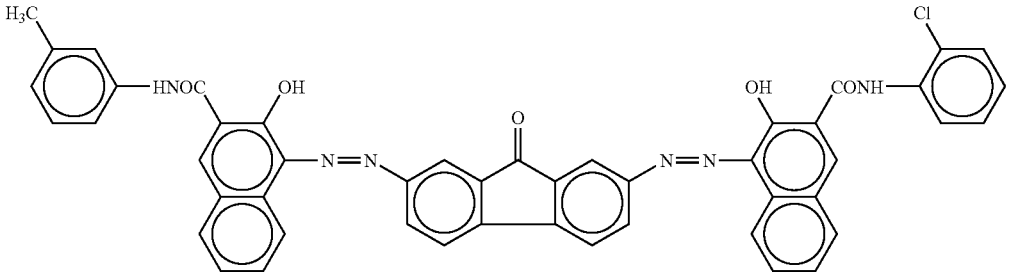
(I)-25
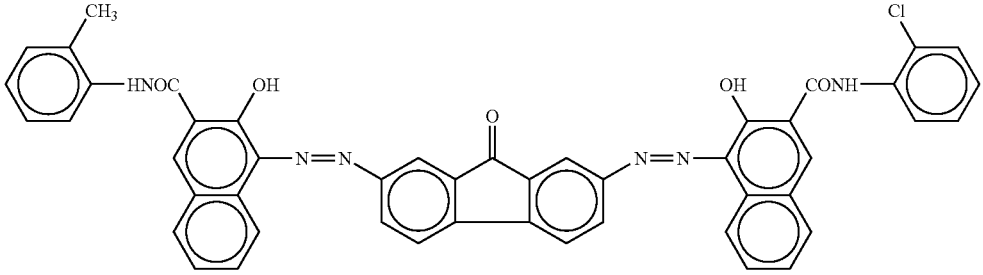
(I)-26
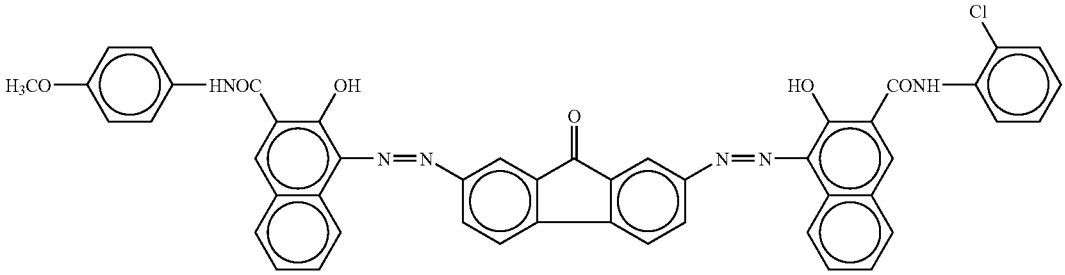
(I)-27
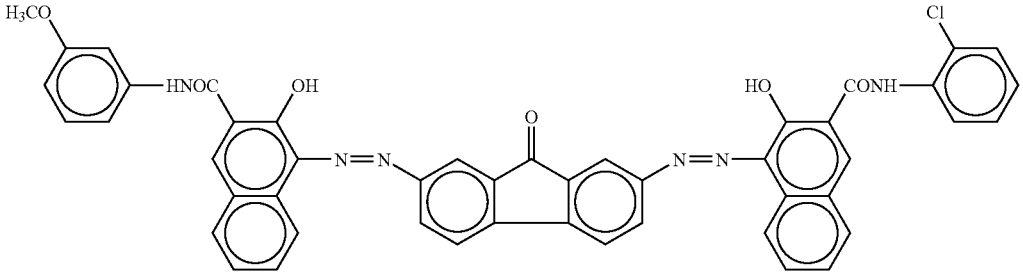

-continued
(I)-28
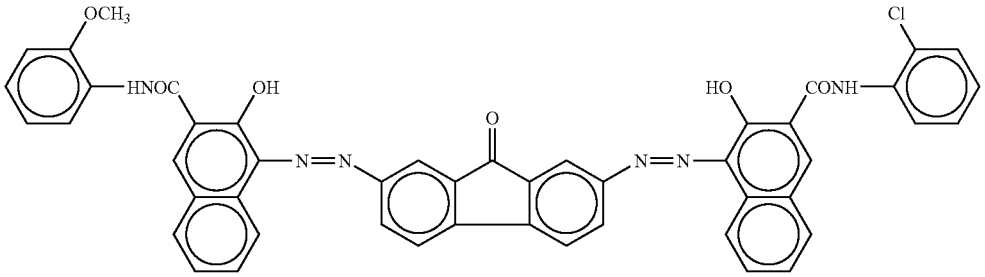
(I)-29
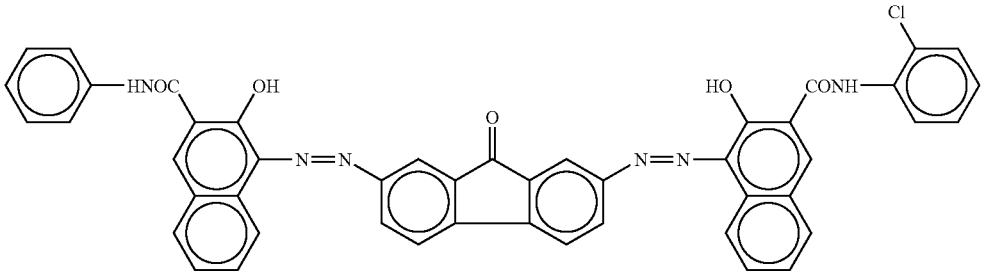
(I)-30
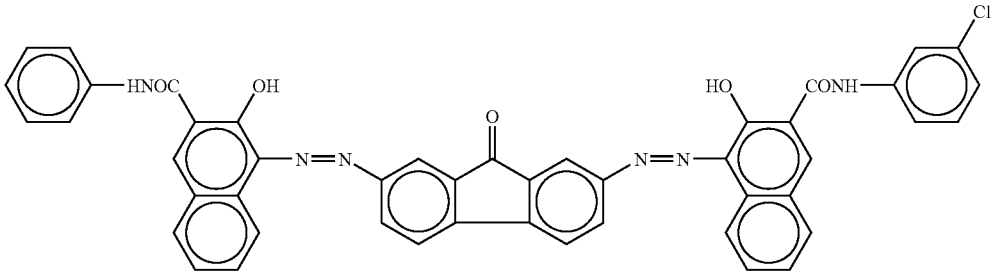
(I)-31
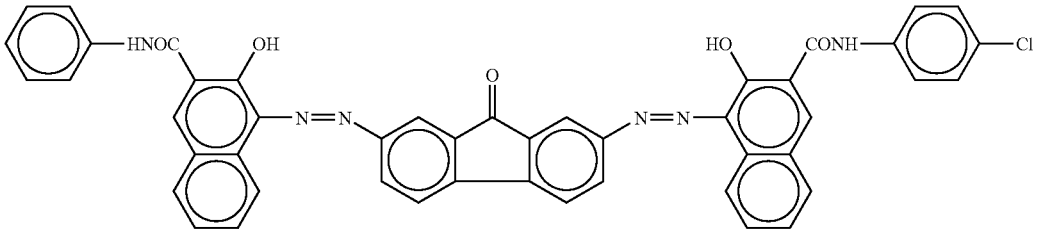
(I)-32
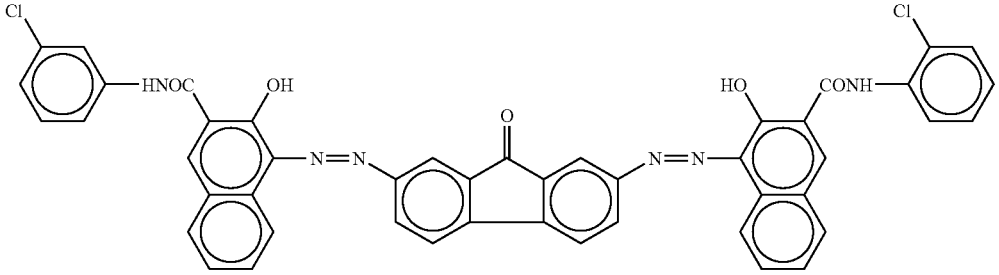

-continued
(I)-33
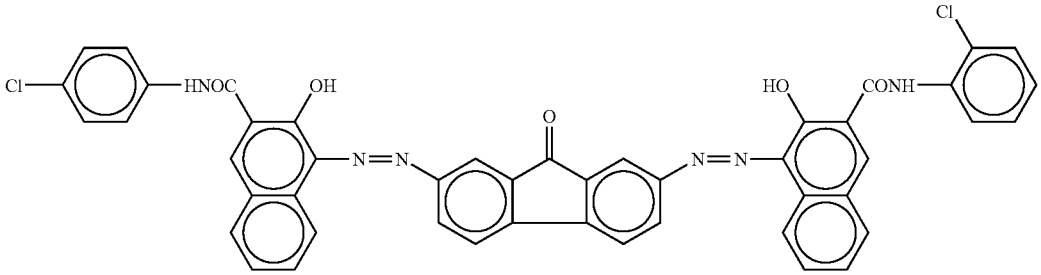
(I)-34
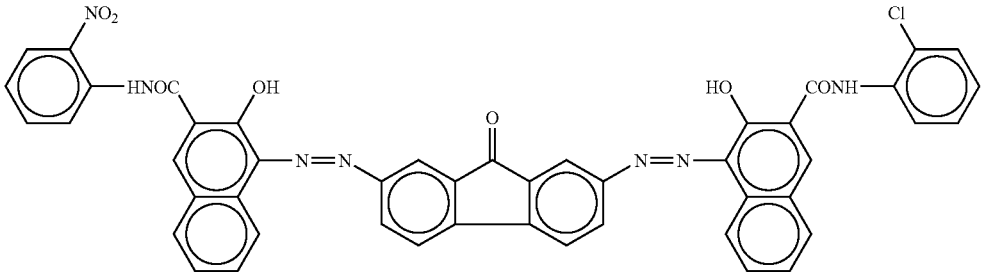
(I)-35
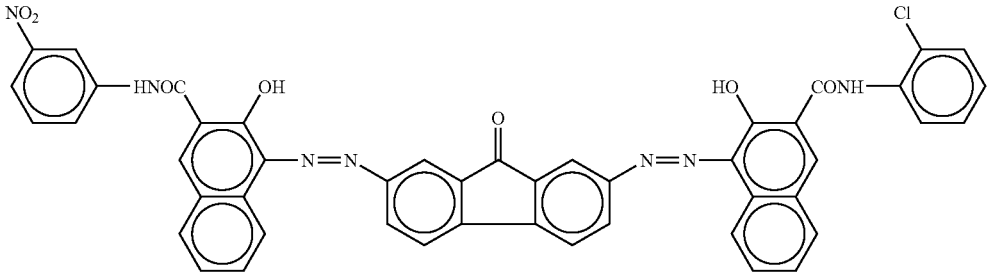
(I)-36
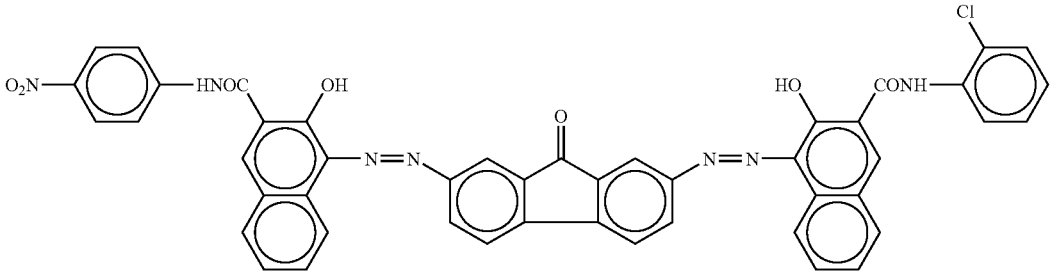
(I)-37
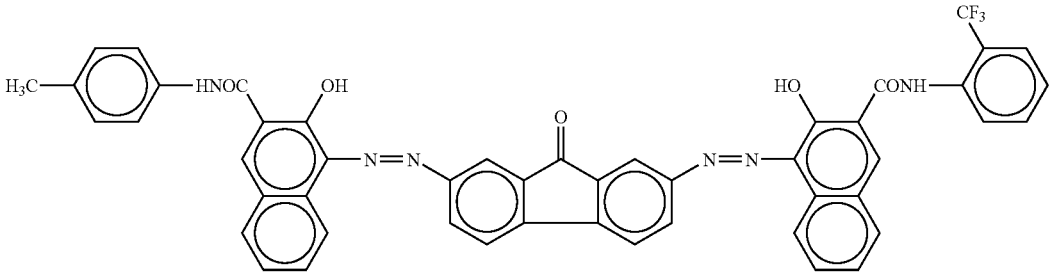

-continued
(I)-38
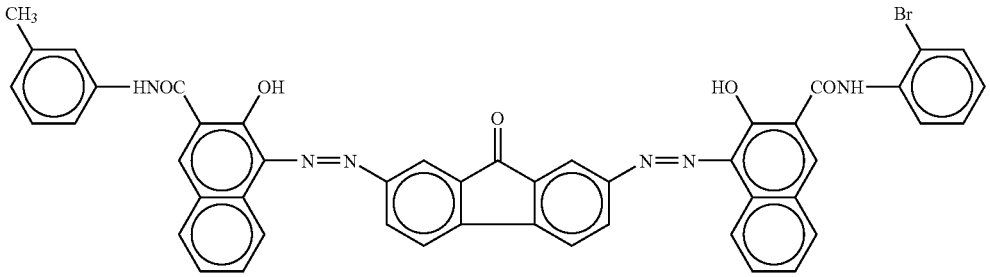
(I)-39
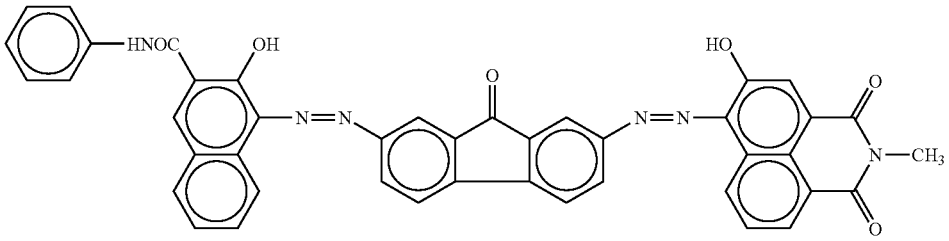
(I)-40
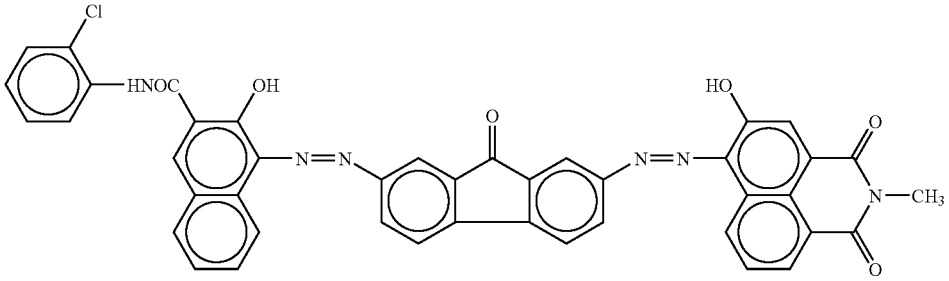
(I)-41
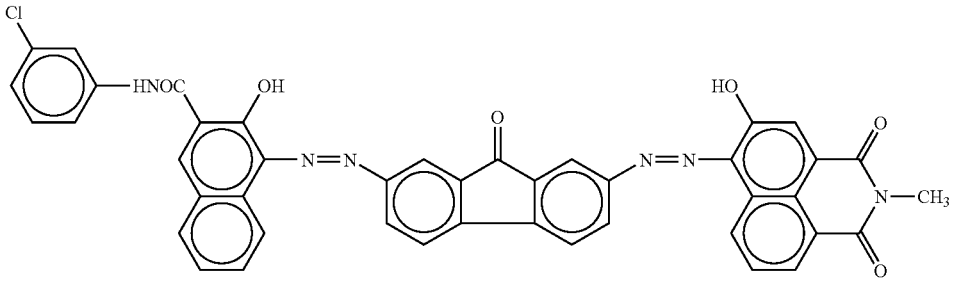
(I)-42
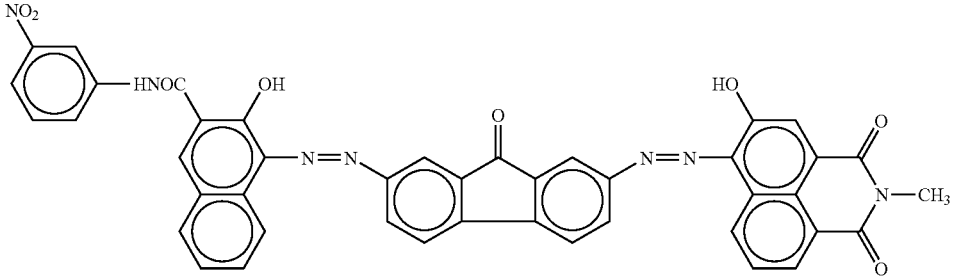

-continued
(I)-43
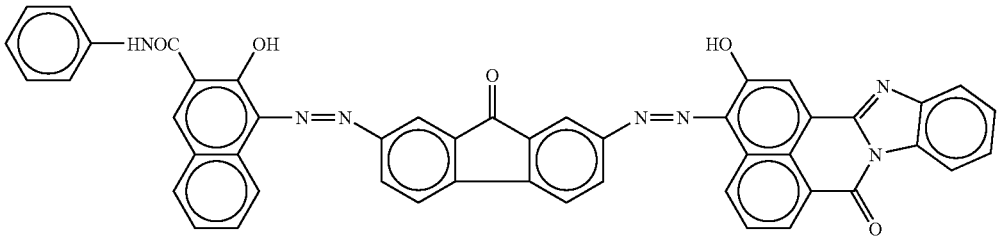
(I)-44
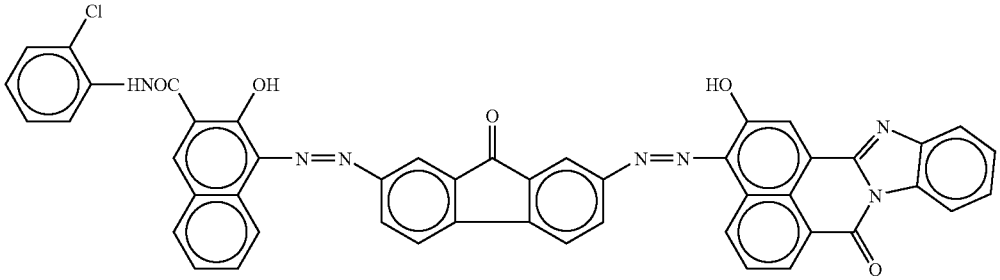
(I)-45
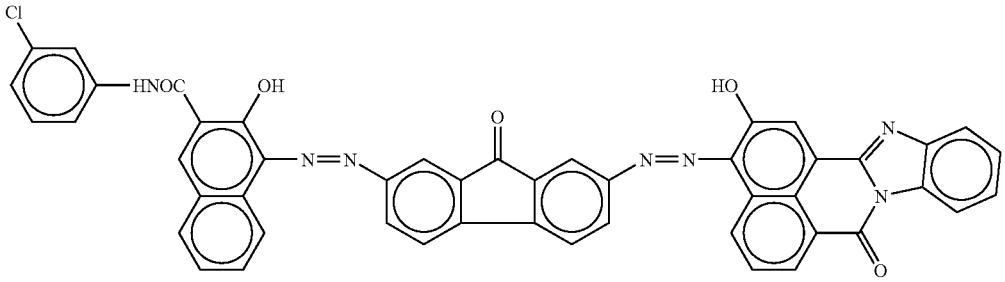
(I)-46
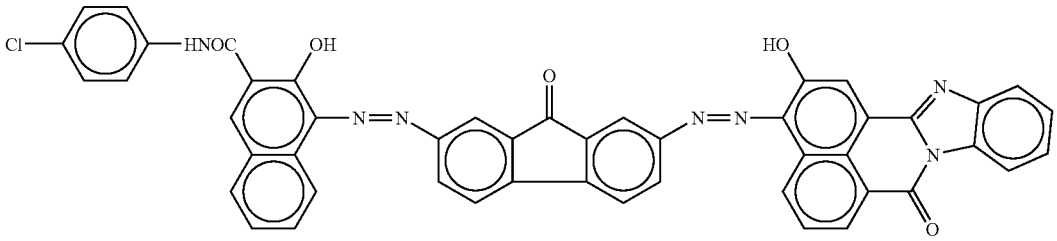
(I)-47
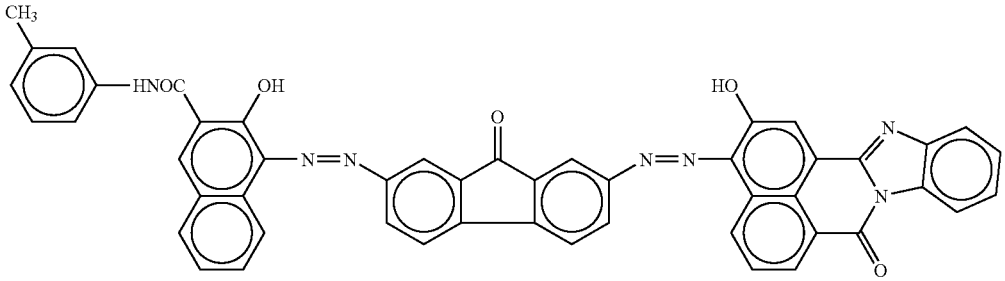

-continued
(I)-48
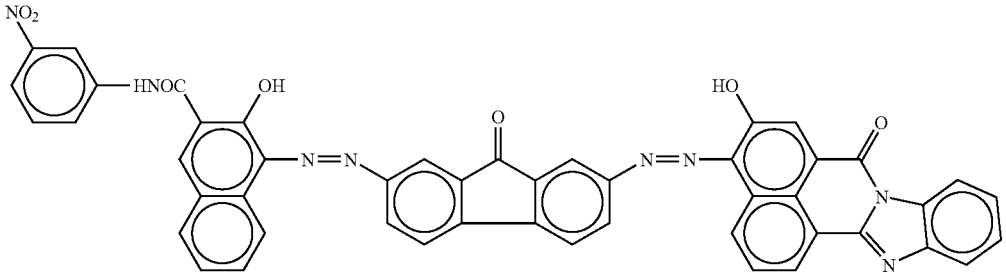
(I)-49
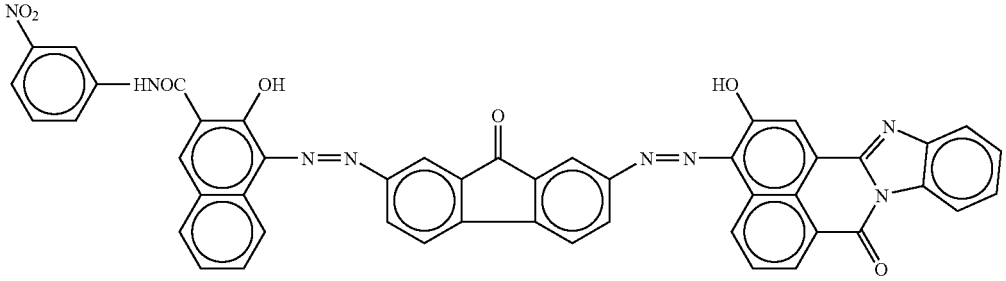
(I)-50
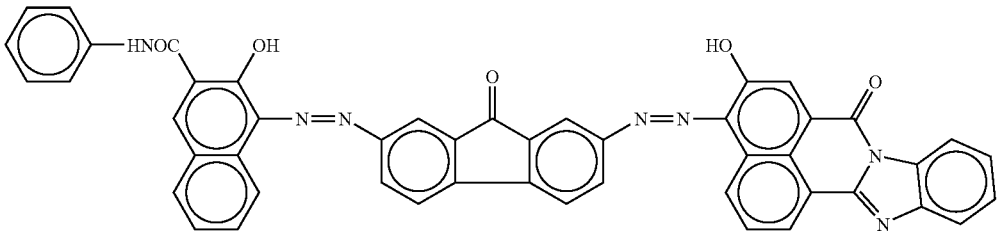
(I)-51
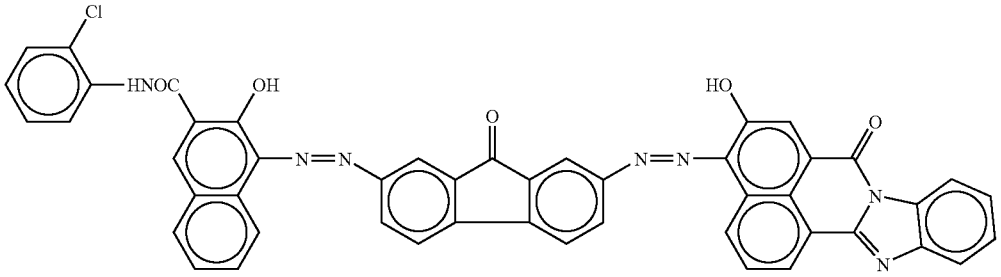
(I)-52
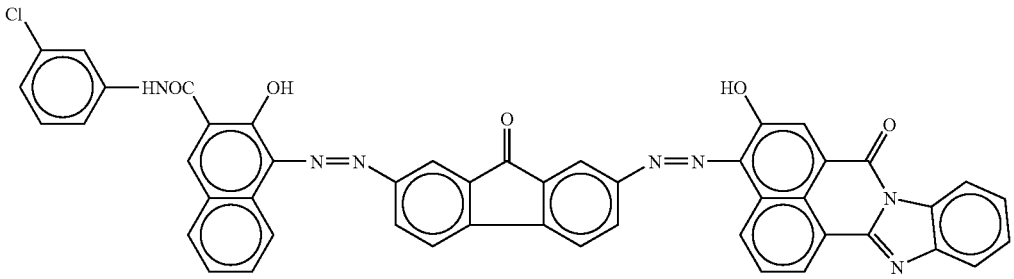

-continued
(I)-53
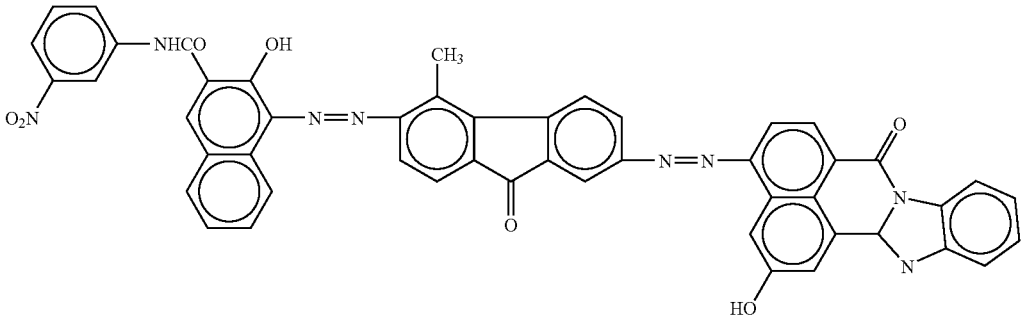
(I)-54
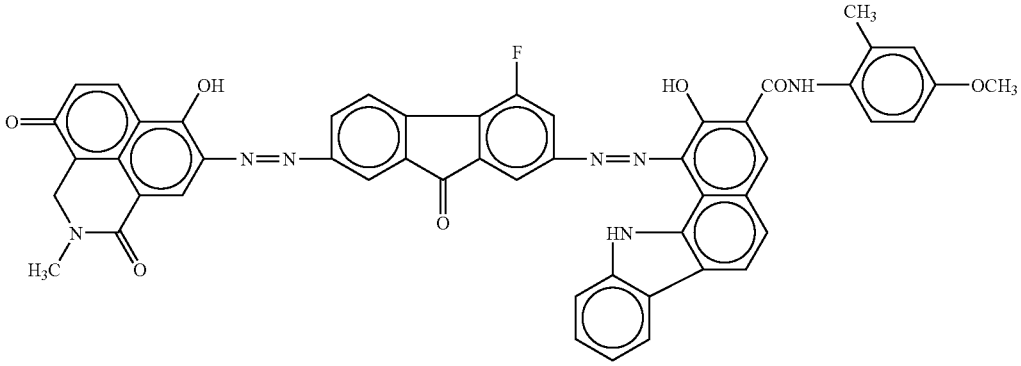
(I)-55
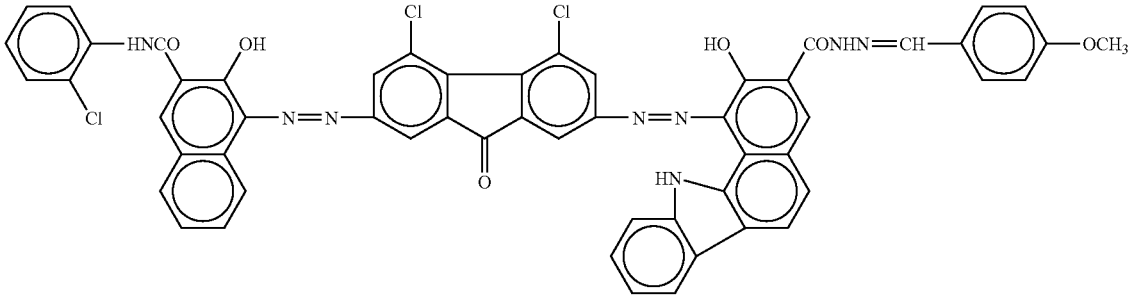
(I)-56
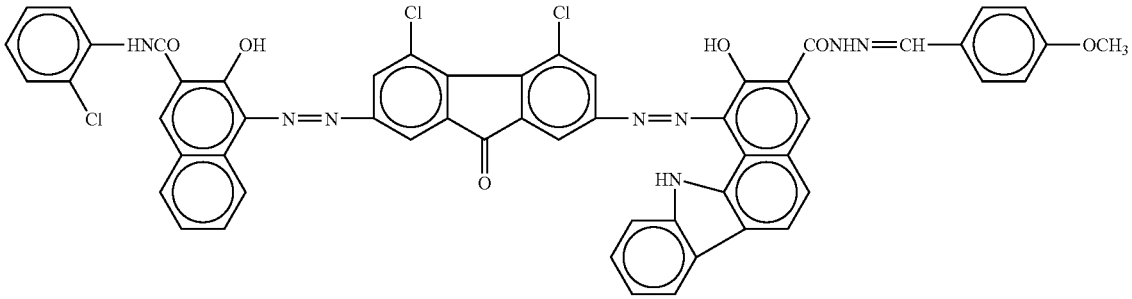
(I)-57
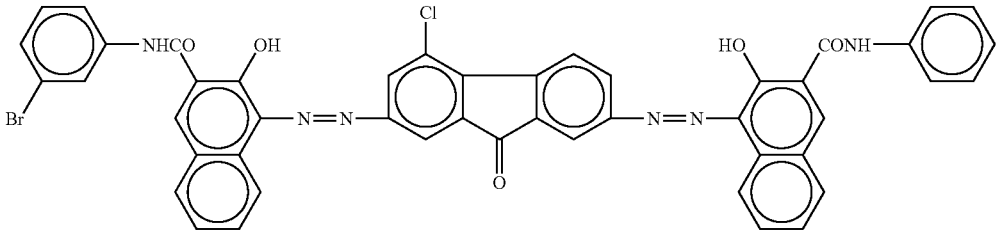

-continued (I)-58

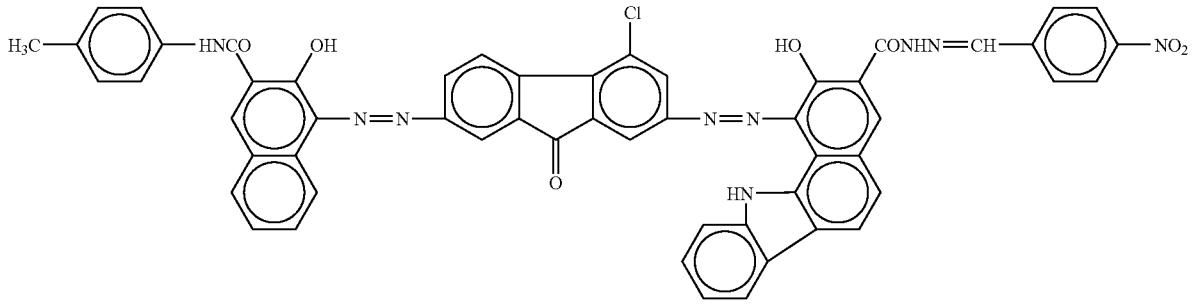

(I)-59

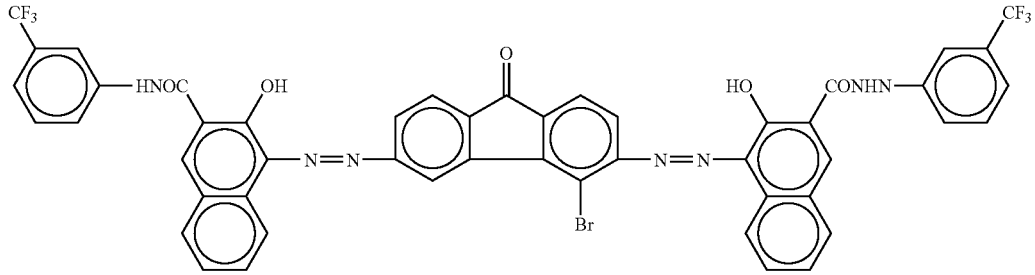

Since the asymmetric azo pigments are asymmetric, it is considered that the asymmetric pigment has more polarized charge distribution than that of a symmetric azo pigment. Thus, the asymmetric azo pigments are generally highly sensitive to light and have high ionization potential. Consequently, the asymmetric azo pigments described above included in the compounds represented by the general formula (I) match with a number of the charge transfer materials so that high quality images can be achieved.

Also, a charge generating material may be employed independently or a mixture of more than one kind of charge generating material may also be employed.

The charge generating layer 35 can be formed by applying a dispersed system of the charge generating material, in combination with a binding resin if required, in a suitable solvent, onto the conductive support, which dispersed system is prepared by the ball mill, the attritor, the sand mill, and ultrasonic wave, and subsequently drying the applied dispersed system.

According to need, as the binding resin used in the charge generating layer 35, given are polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzal, polyester, phenoxy resin, vinyl chloride-vinyl acetate copolymer, polyvinyl acetate, polyphenylene oxide, polyvinylpyridine, cellulose-based resin, casein, polyvinyl alcohol, and polyvinylpyrrolidone. The amount of the binding resin should be 0-500 parts by weight, more preferably 10 through 300 parts by weight, per 100 parts by weight of the charge generating material.

The binding material may be added before or after the preparation of the dispersed system.

As the solvent used herein, given are isopropanol, acetone, ethyl methyl ether, cyclohexanone, tetrahydrofuran, dioxane, ethylcellosolve, ethyl acetate, methyl acetate, dichloromethane, dichloroethane, monochlorobenzene, cyclohexane, toluene, xylene, and ligroin. However, particularly, ketone-based solvent, ester-based solvent, and ether-based solvent are preferably used. The solvent may be employed independently, and a mixture of more than one kind of solvent may also be employed.

The charge transfer layer 35 is based on the charge transfer material, the solvent, and the binding resin, and may contain any additive such as a sensitizer, a dispersing agent, a surfactant, and silicone oil.

As a method of applying the dispersed system, the dip coating method, the spray coating method, the beat coating method, the nozzle coating method, the spin coating method, and the ring coating method may be used. The thickness of the charge generating layer 35 should be approximately 0.01 through 5 μm, more preferably, 0.1 through 2 μm.

The charge transfer layer 37 can be formed by applying a dispersed system or solution of the charge transfer material and a binding resin in a suitable solvent, onto the charge generating layer, and subsequently drying the applied dispersed system or solution. Also, according to need, one or more of a plasticizer, a leveling agent, an anti-oxidant, and a lubricant can be added and useful.

For the charge transfer layer 37, any publicly known charge transfer material that satisfies the following relationship (I) between the ionization potential of the charge generating material Ip(CG) and the ionization potential of the charge transfer material Ip(CT);

$$Ip(CG) \geqq Ip(CT) \quad \text{(I)}$$

has to be employed, according to the present invention.

As the charge transfer material, poly-N-vinylcarbazole and the derivatives thereof, poly-γ-carbazolylethyl gultamate and the derivatives thereof, pyrene-folmaldehyde condensation compound and the derivatives thereof, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives may be used. Among the above-mentioned compounds, since triarylamine derivatives have large mobility of carriers and good gas resistance, the triarylamine derivatives are preferably used. The charge transfer material may be employed independently or a mixture of more than one kind of charge transfer material may also be employed.

As the binding resin, given are thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyallylate, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The amount of the charge transfer material should be 20 through 300 parts by weight, more preferably 40 through 150 parts by weight, per 100 parts by weight of the binding resin. Also, it is preferable that the thickness of the charge transfer layer be equal to or less than 35 μm for keeping the cost low and maintaining the uniformity of the applied film of the charge transfer layer. When the thickness is equal to or less than 20 μm, the effect of the present invention become further significant. The lower limit of the thickness is different dependent on the design of the image information apparatus to be used (particular electric potential for charging the photoconductor), but the lower limit is preferably equal to or more than 5 μm.

As the solvent used herein, tetrahydrofuran, dioxane, toluene, dichloromethane, monochlorobenzene, dichloroethane, cyclohexanone, ethyl methyl ketone, and acetone are employed. The solvent may be employed independently or a mixture of more than one kind of solvent may also be employed.

If required for the purpose of improving durability of the photoconductor, a protecting layer 39 may be provided by applying a dispersed system or solution of a filler, a dispersing agent, a binding material, and further charge transfer material in a suitable solvent, on the charge transfer layer 37, and drying the applied dispersed system or solution. The filler used in the protecting layer is added for the purpose of improving the wear resistance of the photoconductor. Fillers are classified as organic fillers and inorganic fillers. As an organic filler, fine particles of fluorocarbon resin such as polytetrafluoroethylene, fine particles of silicone resin, and a-carbon powder are given. On the other hand, as the material of an inorganic filler, given are metals such as copper, tin, aluminum and indium, metal oxides such as silica, tin oxide, zinc oxide, titanium oxide, alumina, zirconium oxide, indium oxide, antimony oxide, bismuth oxide, calcium oxide, antimony-doped tin oxide and tin-doped indium oxide, metal fluorides such as tin fluoride, calcium fluoride and aluminum fluoride, potassium titanate, and boron nitride. Among the fillers, employment of an inorganic filler in view of the hardness of the fillers is advantageous for improving the wear resistance of the photoconductor.

It is preferable that the average primary particle diameter of the filler be 0.01 through 0.5 μm in view of the transparency and wear resistance of the protecting layer. When the average primary particle diameter is less than 0.01 μm, decrease of the wear resistance is caused by decrease of cohesiveness or dispersiveness of the filler. On the other hand, when the average primary particle diameter is more than 0.5 μm, sedimentation of the filler would be promoted and an abnormal image would be found in an image obtained by a photoconductor in which the filler is used.

For the binding resin contained in the protecting layer, any of the binding resins used for the charge transfer layer 37 can be employed. However, since the dispersiveness of the filler is influenced by the binding resin, it is important not to provide the dispersiveness with a bad influence. Additionally, a resin having an acid value is useful for reducing the rest electric potential on the surface of the photoconductor. Accordingly, as the binding resin, a resin having an acid value can be used independently or a mixture of a resin having an acid value and another binding resin may be used. As examples of the resins having an acid value, given are resins and copolymers such as polyester, polycarbonate, acrylic resin, polyethylene terephthalate, polybutylene terephthalate, each kind of copolymer employing acrylic acid and methacrylic acid, styrene-acryl copolymer, polyallylate, polyacrylate, polystyrene, epoxy resin, ABS resin, ACS resin, olefin-vinylmonomer copolymer, chlorinated polyether, aryl resin, phenol resin, polyacetal, polyamide, polyamide imide, ployallylsulfone, polybutylene, polyether sulfone, polyethylene, polyimide, polymethylbentene, polypropylene, polyphenylene oxide, polysulfone, AS resin, butadiene-styrene copolymer, polyurethane, polyvinyl chloride, and polyvinylidene chloride. A mixture of more than one kind of the above-mentioned materials can also be used.

Since the binding resin strongly influences image blur, use of a binding resin having a high resistance to $NO_x$ or ozone not only suppresses image blur but also has the effect of improving wear resistance. For the binding resin, a polymer alloy can be employed, and at least a polymer alloy with polyethylene terephthalate that has a high image blur suppression effect is useful.

In the present invention, it is preferable that the protecting layer contain at least one kind of charge transfer material, for reducing the rest electric potential on the surface of the photoconductor. As the charge transfer material contained in the protecting layer, any of the aforementioned charge transfer materials contained in the charge transfer layer 37 formed on the charge generating layer can be employed. However, the charge transfer material contained in the protecting layer may be different from the charge transfer material contained in the charge transfer layer. In this case, as the charge transfer material contained in the protecting layer has ionization potential lower than that of the charge transfer material contained in the charge transfer layer, electron injection efficiency at the interface between the protecting layer and the charge transfer layer can be improved so as to reduce the rest electric potential very effectively.

The ionization potentials of the charge transfer materials can be measured by various methods such as a spectroscopic method and an electrochemical method.

Additionally, a polymeric charge transfer material having both functions of a charge transfer material and a binder resin is advantageously used as the protecting layer. A charge transfer layer containing a polymeric charge transfer material has good wear resistance. Although any publicly known material can be employed as the polymeric charge transfer material, particularly, a polycarbonate containing a main chain and/or a side chain of triarylamine structure is advantageously employed.

The filler can be dispersed with at least a dispersing agent in an organic solvent by a conventional method such as the ball mill, the attritor, the sand mill, and ultrasonic wave. Among the methods, the ball mill that can improve contact efficiency of the filler and the dispersing agent and reduce contamination of an impurity from the surroundings is preferable in view of dispersiveness of the filler. As a material of a medium used in the ball mill, any of conventionally used materials such as zirconia, alumina, and agate can be employed. However, it is preferable to use alumina in view of the dispersiveness of the filler and reducing the effect of the rest electric potential, and α-type alumina having high wear resistance is particularly preferred. Since use of zirconia for the medium causes much abrasion loss of the medium during dispersion of the filler, the rest electric potential increases significantly due to the contamination of the protecting layer by the wearing medium and the contamination by the wearing powder decreases the dispersiveness so as to greatly reduce the sedimentation of the filler.

When alumina is used for the medium, the abrasion loss of the medium can be suppressed to be lower during the dispersion, and the influence on the dispersiveness caused by the contamination of the wearing powder is less than the case of employing another medium. Accordingly, use of alumina for the medium used in the dispersed system is more preferable.

Also, since the dispersing agent suppresses cohesion and sedimentaion of the filler in the dispersed system to be applied and the dispersiveness of the filler is significantly improved, it is preferable to add the dispersing agent with the filler into the organic solvent before dispersion.

On the other hand, the binder resin and the charge transfer material may be added before dispersion, but the dispersiveness may be lowered a little. Accordingly, it is preferable to add the binder resin and the charge transfer material on the condition of being dissolved in the organic solvent after dispersion.

As a method for applying the above obtained dispersed system, conventional application methods such as the dip coating method, the spray coating method, the beat coating method, the nozzle coating method, the spin coating method, and the ring coating method can be used. However, the spray coating method is suitable for forming a comparatively thin film with good dispersiveness of the filler. As the total thickness of the protecting layer, 1 through 10 μm, more particularly 2 through 6 μm, is suitable. When the film is extremely thin, the uniformity of the film may be lowered and enough wear resistance might not be obtained. On the other hand, when the film is extremely thick, elevation of the rest electric potential and decrease in the transmittance of light could cause decreases in the resolution and the dot reprocducibility of an image.

In the photoconductor according to the present invention, an underlying layer may be provided between the conductive support 31 and a photosensitive layer. The material of the underlying layer is generally based on resin. It is desirable that the resin be a resin having high solvent resistance against a general organic solvent, since the photosensitive layer containing a solvent is formed on the underlying layer containing the resin.

As such resin, given are water-soluble resins such as polyvinyl alcohol, casein and polysoudium acrylate, alcohol-soluble resin such as copolymer nylon and methoxymethyl-substituted nylon, and setteing-type resins that form three-dimensional network structures such as polyurethane, melamine resin, phenol resin, alkyd-melamine resin and epoxy resin.

Additionally, fine powder of a pigment of metal oxide such as titanium oxide, silica, alumina, zirconium oxide, tin oxide, and indium oxide is added into the underlying layer for preventing moire from generating and for reducing the rest electric potential. The underlying layer can be formed using a suitable solvent and a proper application method similar to the case of the aforementioned photosensitive layer. For the underlying layer in the present invention, a silane coupling agent, a titanium coupling agent and a chromium coupling agent can be used. Also, each kind of dispersing agent can be used. Additionally, the underlying layer is advantageously provided by anodizing $Al_2O_3$ or by forming a thin film made from an organic material such as polyparaxylylene (parylene) or an inorganic mateiral such as $SiO_2$, $SnO_2$, $TiO_2$, ITO, or $CeO_2$ using a vacuum thin film creating method. As the thickness of the underlying layer, 0 through 5 μm is suitable.

In the photoconductor according to the present invention, a middle layer can be provided between the photosensitive layer and the protecting layer. The material of the middle layer is generally based on a binder resin. As the binder resin, polyamide, alcohol-soluble nylon, water-soluble polyvinyl butyral, polyvinyl butyral, and polyvinylalcohol are given. As a method for forming the middle layer, a generally used application method is employed as described above. As the thickness of the middle layer, approximately 0.05 through 2 μm is suitable.

In the present invention, for the purpose of improving the environmental resistance, preventing the sensitivity to light from decreasing, and preventing the rest electric potential from elevating, a publicly known anti-oxidant, plasticizer, lubricant, ultraviolet rays absorbent, low-molecular charge transfer material, and/or leveling agent may be added into each layer of the charge generating layer, the charge transfer layer, the underlying layer, the protecting layer, and the middle layer.

EXAMPLE 1

Figure 9:
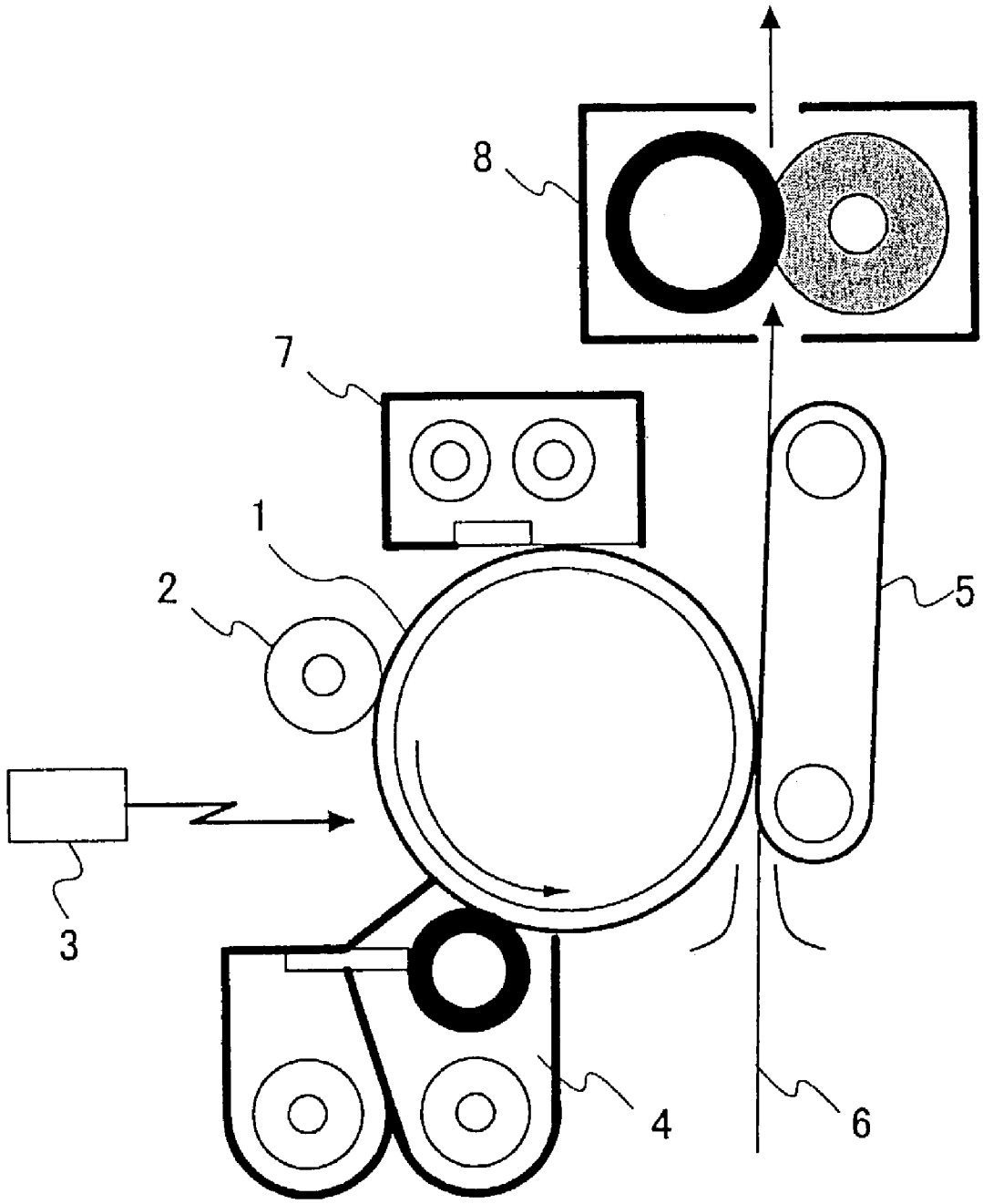
FIG. 9 is a schematic diagram showing an image formation apparatus in example 1 according to the present invention.

An image formation apparatus in example 1 will be schematically illustrated by reference to FIG. 9, of which the basic structure is the same as the conventional image formation apparatus.

1. A photoconductor drum 1 is formed by applying a CT layer with the thickness of 26 μm, a CG layer with the thickness of 0.2 μm, and a UL (underlying) layer with the thickness of 3 μm, onto the surface of a conductor (such as aluminum). The photoconductor drum 1 rotates with the peripheral speed of 230 mm/sec in the direction of the designated arrow shown in FIG. 9, wherein the diameter of the photoconductor drum 1 is 60 mm.

2. Charging means 2 includes a so-called contact roller charging device. In the charging means 2, by using a power supply, a direct voltage (−1.21 kV) is applied to a charging roller provided by forming an elastic layer (with the thickness of 3 mm) having a middle resistance (or conductivity) on a cored bar, so that photoconductor is uniformly charged (at −550 V).

3. Light-exposure means 3 forms a latent image on the surface of the photoconductor that has been uniformly charged by the charging means, by irradiating light corresponding to a desired image. The light source in the light-exposure means is a laser diode. The laser beam emitted from the laser diode irradiates the photoconductor and scans the surface of the photoconductor via a polygon mirror. So-called beam diameters are 35 μm in the main-scanning direction and 35 μm in the sub-scanning direction.

4. Developing means 4 includes a so-called two-component development device. In the development device, a developer prepared by mixing toners (with a volume-average particle diameter of 6.8 μm) and carriers (with a particle diameter of 50 μm) for the toner is contained in a development container, wherein the concentration of the toner in the developer is 5.0%. In the development device, the developer is carried by a development sleeve toward an end of the development sleeve, opposing the photoconductor. The distance between the photoconductor and the development sleeve (so-called development gap) is 0.3 mm. A direct voltage (−400V) is applied on the development sleeve by a power supply, so that toners adhere to the photoconductor according to the latent image formed on the photoconductor (so-called reversal development). The peripheral speed of the development sleeve is 460 mm/sec, that is, the so-called the ratio of peripheral speeds is 2.0.

5. Transcribing means 5 transcribes a toner image that has been developed by the developing means, onto a recording sheet 6 carried from paper feeding means not shown in the figure. The transcribing means in example 1 includes a transcribing belt and a power supply. A voltage is applied to the transcribing belt by the power supply, and the applied voltage is controlled by a constant current being 30 μA.

6. Cleaning means 7 includes a blade made of an elastic body and performs cleaning for removing a residual toner image (so-called transcribed residual toners) on the photoconductor.

7. The toner image that has been transcribed on the recording sheet (such as a paper) by the transcribing means is carried toward fixing means 8. Then, the toner image is heated and pressed by the fixing means so that the toner image is fixed on the recording paper. Finally, the toner image is ejected outside the image formation apparatus as an output image.

Also in example 1, a desired image can be formed on the recording sheet by repeating the aforementioned processes 1 through 7.

Figure 10:
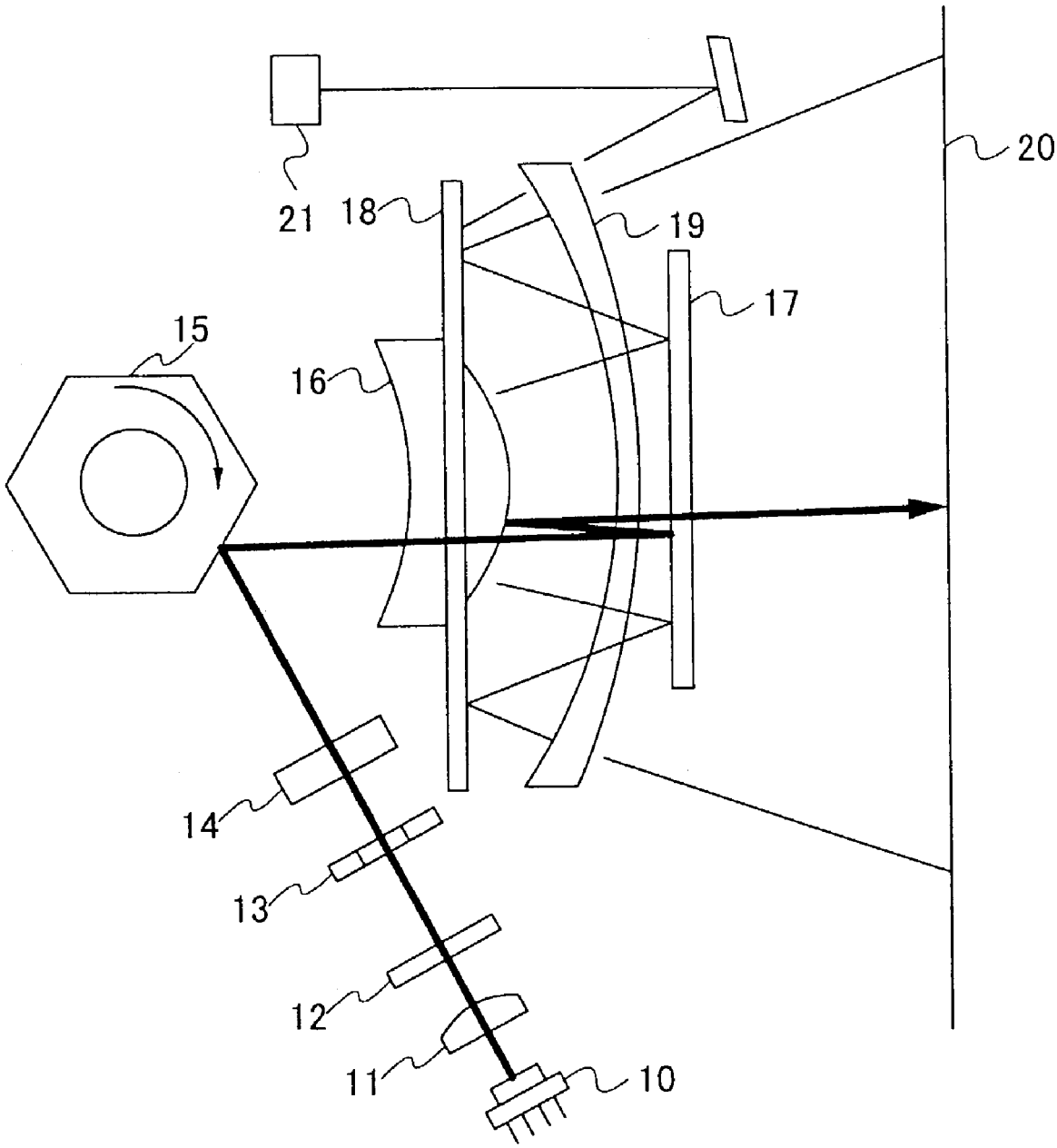
FIG. 10 is a schematic diagram showing an optical unit in example 1 according to the present invention.

FIG. 10 shows a writing unit in example 1. The writing unit includes a 4 ch (channel) type-LD array having four LDs (laser diodes) 10 for emitting a light at the wavelength of 655 nm. The laser light beam emitted from the LD and passing through a collimator lens 11, a ND filter 12, an aperture 13 and a cylindrical lens 14 irradiates a polygon mirror 15.

In example 1, the polygon mirror is a hexagonal type mirror and rotates with a rotational frequency of 2716.5 rpm. The laser light beam reflected from the polygon mirror is imaged on the surface of the photoconductor 20 through turning mirrors 17 and 18 and f-θ lenses 16 and 19. In example 1, so-called beam diameters of the laser beam on the photoconductor are adjusted to be 35 μm in the main-scanning direction and 35 μm in the sub-scanning direction.

In example 1 the f-θ lenses are a molded plastic and designed so that the lens shape includes a so-called AC (aspheric cylindrical) surface. As a result, an extremely thin beam having beam diameters of 35 μm in the main-scanning direction and 35 μm in the sub-scanning direction can be provided. Also, the laser light scans the surface of the photoconductor as the polygon mirror rotates.

In example 1, the image formation apparatus has a resolution of 1200 dpi, and pixel size is 21.3 μm×21.3 μm. The laser beam scans the surface of the photoconductor with the scanning speed of 16.9 nsec per 1 pixel. In this case, a so-called pixel clock is at 59.2 MHz, meaning that the LD is light-modulated with the frequency of 59.2 MHz.

Additionally, in example 1, although the laser light scans the surface of the photoconductor dependent on the rotation of the polygon mirror as described above, when the laser light beam does not arrive on an image area of the photoconductor, the laser light beam enters a synchronization detection plate 21 as shown in FIG. 10. The synchronization plate has a mechanism that generates a control signal. Based on the control signal, timing for starting to write an image is controlled or a clock signal formed using the pixel clock as a unit is reset. Consequently, a light-modulated laser light irradiates the surface of the photoconductor at a desired position.

Furthermore, in example 1, so-called 4-value writing is performed by changing the pulse width at 4 steps so as to accomplish a 4-step tone representation per pixel.

(Specification of the Photoconductor)

From bottom to top, an underlying layer with the thickness of 3.5 μm, a charge generating layer with the thickness of 0.2 μm, and a charge transfer layer with the thickness of 26 μm were formed on an aluminum cylinder with the diameter of 60 mm by applying a coating liquid for the underlying layer, a coating liquid for the charge generating layer, and a coating liquid for the charge transfer layer, which have the following compositions, and drying the coating liquids.

(The coating liquid for the underlying layer)

Titanium dioxide powder: 400 parts

Melamine resin: 65 parts

Alkyd resin: 120 parts 2-butanone: 400 parts (The coating liquid for the charge generating layer)

Azo pigment represented by the following structural formula (IV): 2 parts

Polyvinyl butyral (S-LEC BM-1 made by Sekisui Chemical Co., Ltd.): 1.0 parts

Cyclohexanone: 30 parts

Ethyl methyl ketone: 70 parts (IV)

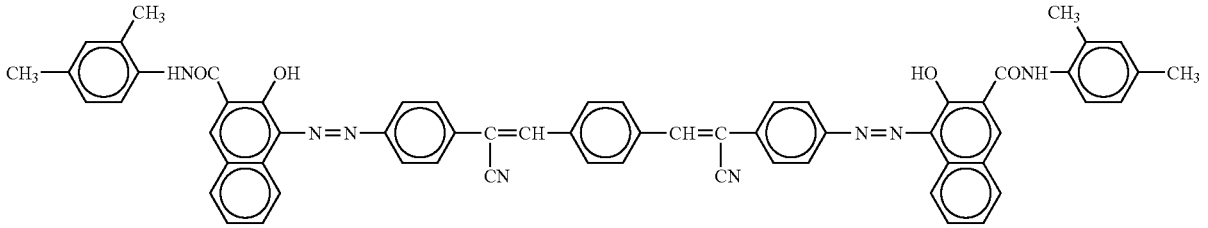

Ip (CG) = 5.78 eV (The coating liquid for the charge transfer layer)

Polycarbonate (Z policarbonate made by Teijin Chemicals Ltd.): 10 parts

Charge transfer material represented by the following structural formula (2): (Ip: 5.4 eV): 6 parts Tetrahydrofuran: 100 parts (2)

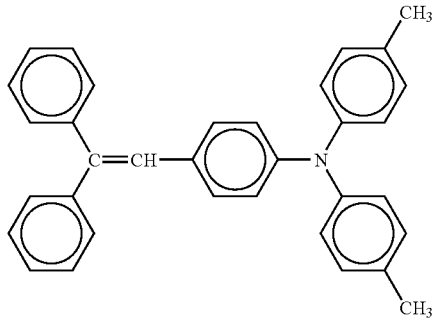

(Image quality evaluation method)

Figure 11:
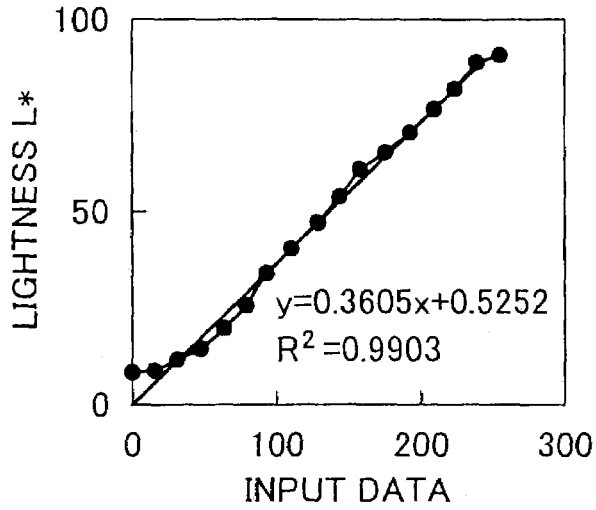
FIG. 11 is a graph of one example indicating that tone being an important matter for image quality is better (when $R^2$ approximates 1)
Figure 12:
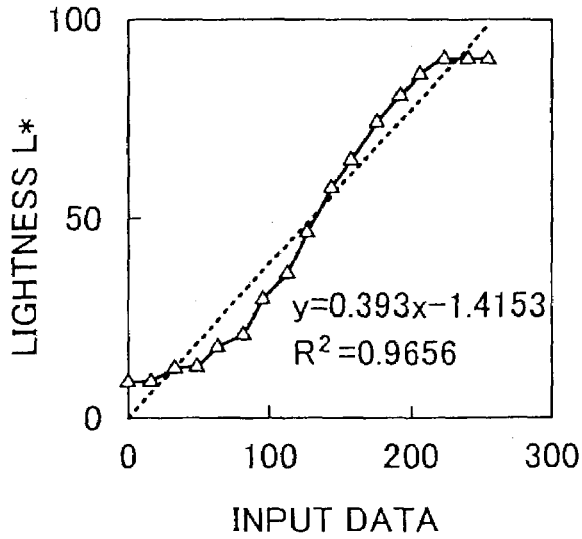
FIG. 12 is a graph of one example indicating that tone being an important matter for image quality is worse (when $R^2$ is smaller).

Image quality was evaluated by measuring tone that is an important matter regarding an image quality. The tone was evaluated by measuring lightness (L★) of output patches that had been subjected to halftone processing with change in the line frequency of the patches (17 steps). In the halftone processing, the images of the patches were output at the level of the line frequency of 200 lpi. Also, for the measurement of the lightness (L★), a spectral density calorimeter (938 made by X-Rite Company) was used. Digitization of the tone was performed by calculating a so-called $R^2$ (square of an autocorrelaion coeficient for a first order approximation) for the linearity of the lightness values relative to input data (the line frequencies at 17 steps) with respect to the patches. The $R^2$ value approximates 1 (FIG. 11) if the relationship between the lightness (L★) and the above-mentioned input data is linear while the value becomes smaller as the relationship deviates from linear (FIG. 12).

Also, the inventors performed a subjective evaluation for an image such as a natural image that is required to have high tone, and then an $R^2$ value of equal to or more than 0.98 was defined as good tone. $R^2$ value tends to be larger in an image with a smaller line frequency. However, when the line frequency was less than 200 lpi, the texture of dithers was recognized. Thus, the natural image created an unnatural impression and the image quality was lowered. As a result, the inventors judged that image quality was high if the line frequency in the halftone processing was equal to or more than 200 lpi and the tone value $R^2$ was equal to or more than 0.98. The tone value $R^2$ may be ecual to or more than 0.980.

The recording density relates to image quality of a character or line image, particularly, to jaggies of the image. In order to make jaggies negligible, a line frequency of equal to or more than 900 dpi is required, and in order to achieve high quality, the line frequency of equal to or more than 1200 dpi is required.

The inventors used a remodeled MF4570 for 1200 dpi and 2-bit writing made by RICOH Co, Ltd. as a test machine and evaluated image quality of an output image obtained by the above-mentioned method. The beam diameters were measured by a Beam Scan made by PHOTON Co., Ltd. and the thickness of OPC film was measured by a thickness meter made by Fischer Scope.

EXAMPLE 2

The azo pigment being used in example 1 as the charger generating material used in the charge generating layer was exchanged in example 2 for the material represented by the following structural formula (V). Then, similar to example 1, a photoconductor was made and image output and image quality evaluation were performed.

(V)

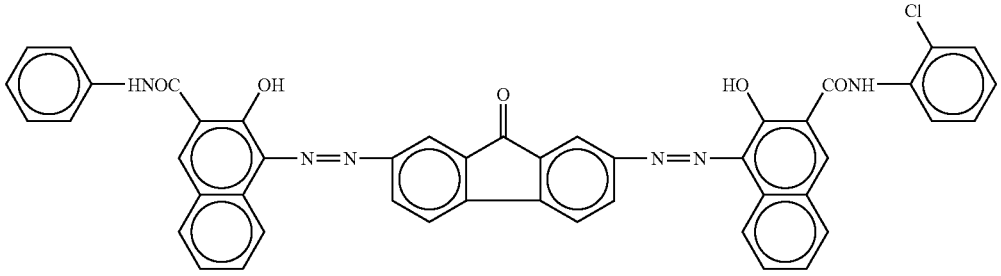

Ip (CG) = 5.80 eV

EXAMPLES 3-9 AND COMPARISONS 1 AND 2

The azo pigment being used in example 1 as the charger generating material used in the charge generating layer was exchanged in examples 3-9 and comparisons 1-2 for the material represented by the following structuralformula (VI).

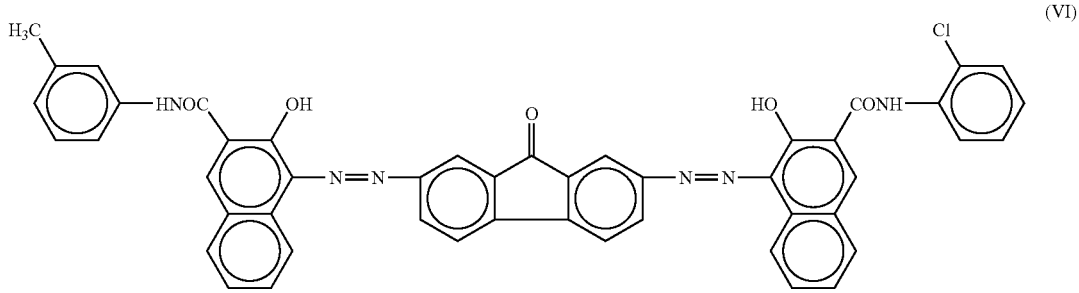

(VI)

Ip (CG) = 5.86 eV

In addition, photoconductors in examples 3-9 and comparisons 1 and 2 are similar to the photoconductor in example 1 except for exchanging the charge transfer material used in the charge transfer layer with the materials listed in Table 1, respectively. Then, image output and image quality evaluation were performed similar to example 1.

Table 1: List of charge transfer materials

| | Charge transfer material | Ip(CT) | Ip(CG)–Ip(CT) |
|---|---|---|---|
| Example 3 | 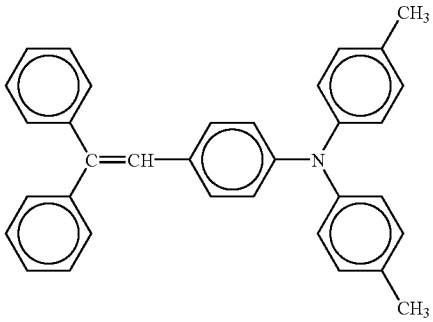 | 5.44 | 0.42 |
| Example 4 | 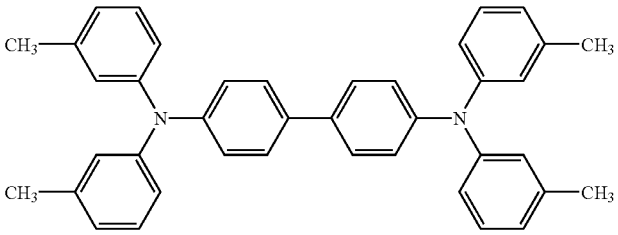 | 5.3 | 0.56 |

-continued
| | Charge transfer material | Ip(CT) | Ip(CG)–Ip(CT) |
|---|---|---|---|
| Example 5 | 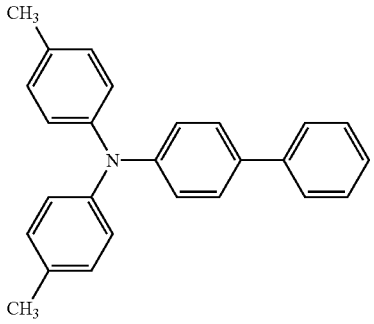 | 5.6 | 0.26 |
| Example 6 | 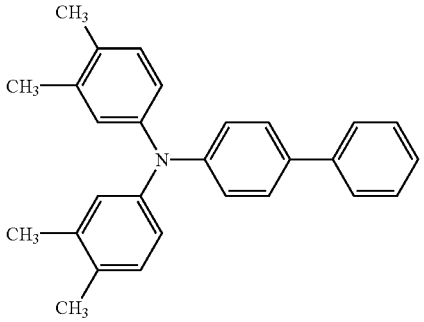 | 5.52 | 0.34 |
| Example 7 | 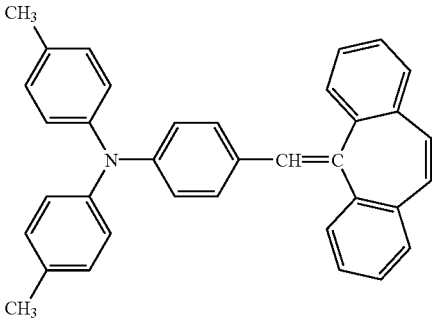 | 5.45 | 0.41 |
| Example 8 | 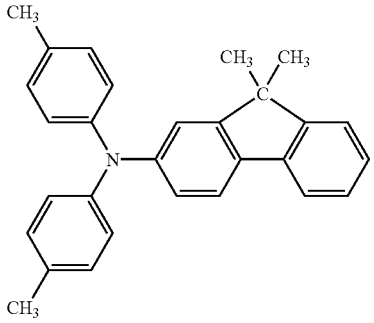 | 5.4 | 0.46 |

-continued

| | Charge transfer material | Ip(CT) | Ip(CG)–Ip(CT) |
|---|---|---|---|
| Example 9 | 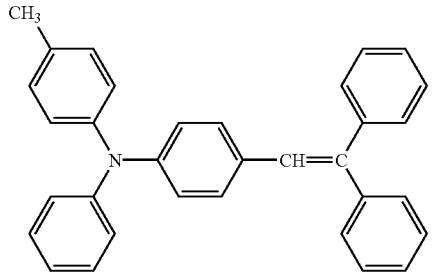 | 5.5 | 0.36 |
| Comparison 1 | 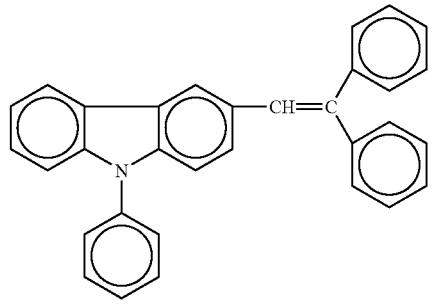 | 5.91 | −0.05 |
| Comparison 2 | 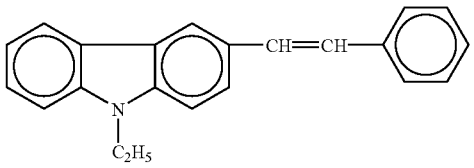 | 6.01 | −0.15 |

COMPARISON 3

The azo pigment being used in example 9 as the charger generating material used in the charge generating layer was exchanged in comparison 3 for a titanyl phthalocyanine pigment (showing strong peaks at diffraction angles 2θ+0.2° of 9.5°, 9.7°, 11.7°, 15.0°, 23.5°, 24.1° and 27.3° in Cu-Kα characteristic X-rays diffraction, Ip(CG)=5.2 eV). Then, similar to example 9, a photoconductor was made and image output and image quality evaluation were performed.

COMPARISON 4

The azo pigment being used in example 9 as the charger generating material used in the charge generating layer was exchanged in comparison 4 for a titanyl phthalocyanine pigment (showing strong peaks at diffraction angles 2θ±0.2° of 9.0°, 14.2°, 23.9° and 27.1° in Cu-Kα characteristic X-rays diffraction, Ip(CG)=5.3 eV). Then, similar to example 9, a photoconductor was made and image output and image quality evaluation were performed.

For the manufactured photoconductors in examples 1-9 and comparisons 1-4 as described above, image evaluation was performed using the aforementioned remodeled MF4570 for 1200 dpi and 2-bit writing made by RICOH Co, Ltd. as a test machine. Herein, the beam diameters are 35 μm and the writing density is 1200 dpi. In halftone processing, images were output at the level of the line frequency of 200 lpi and the result of the image quality evaluation is shown in Table 2.

TABLE 2

| Results of image quality evaluation | |
|---|---|
| | Tone $R^2$ |
| Example 1 | 0.980 |
| Example 2 | 0.984 |
| Example 3 | 0.985 |
| Example 4 | 0.984 |
| Example 5 | 0.982 |
| Example 6 | 0.983 |
| Example 7 | 0.984 |
| Example 8 | 0.985 |
| Example 9 | 0.984 |
| Comparison 1 | 0.976 |
| Comparison 2 | 0.974 |
| Comparison 3 | 0.970 |
| Comparison 4 | 0.972 |

EXAMPLE 10-16 AND COMPARISON 5-8

Image output and image quality evaluation were performed similar to example 9 except for changing the thickness of the charge transfer layer in the photoconductors, the diameters of the writing beam, and writing densities to values shown in Table 3. In halftone processing, images were output at the level of the line frequency of 240 lpi as well as 200 lpi and the image quality was evaluated.

TABLE 3

| List of set conditions | Writing density (dpi) | Thickness of charge transfer layer (μm) | Writing beam diameter (μm) |
|---|---|---|---|
| Example 10 | 1200 | 26 | 25 |
| Comparison 5 | 1200 | 26 | 45 |
| Example 11 | 1200 | 20 | 25 |
| Example 12 | 1200 | 20 | 35 |
| Comparison 6 | 1200 | 20 | 45 |
| Example 13 | 1800 | 26 | 25 |
| Example 14 | 1800 | 26 | 35 |
| Comparison 7 | 1800 | 26 | 45 |
| Example 15 | 1800 | 20 | 25 |
| Example 16 | 1800 | 20 | 35 |
| Comparison 8 | 1800 | 20 | 45 |

The result of the image quality evaluation is shown in Table 4.

TABLE 4

| Result of image quality evaluation | Tone $R^2$ | |
|---|---|---|
| | 200 lpi | 240 lpi |
| Example 10 | 0.987 | 0.985 |
| Example 11 | 0.990 | 0.988 |
| Example 12 | 0.988 | 0.978 |
| Example 13 | 0.985 | 0.983 |
| Example 14 | 0.982 | 0.972 |
| Example 15 | 0.989 | 0.986 |
| Example 16 | 0.985 | 0.975 |
| Comparison 5 | 0.974 | 0.955 |
| Comparison 6 | 0.979 | 0.960 |
| Comparison 7 | 0.972 | 0.950 |
| Comparison 8 | 0.978 | 0.958 |

As described above, Table 2 shows measurements of tone (the $R^2$s) relative to various combinations of ionization potential of the charge generating material contained in the charge generating layer Ip(CG) with ionization potential of the charge transfer material contained in the charge transfer layer Ip(CT). From the result shown in Table 2, an image formation apparatus that can form an image with high tone can be provided by using an electrophotographic photoconductor that satisfies the relationship Ip(CG)≧Ip(CT) without making the charge transfer layer thinner. Of course, the tone of an image can be further improved by making the charge transfer layer thinner.

Accordingly, in an image formation apparatus using an elecrophotographic process, in which the resolution for light-writing is equal to or more than 1200 dpi, and/or in which light-writing is performed based on image data formed by applying halftone processing at a line frequency of equal to or more than 200 lpi to input image data, it becomes obvious that a high quality image with tone value $R^2$ of equal to or more than 0.98 can be obtained when the light-writing means includes a laser light beam with a beam diameter of equal to or less than 35 μm, the photo conductor includes at least a charge generating layer containing a charge generating material and a charge transfer layer containing a charge transfer material on a conductive support, and ionization potential of the charge generating material contained in the charge generating layer Ip(CG) and ionization potential of the charge transfer material contained in the charge transfer layer Ip(CT) satisfy the relationship of Ip(CG)≧Ip(CT).

Also, an image having better image quality can be obtained by using an asymmetric disazo pigment as a charge generating material used in the charge generating layer. Since it is considered that the asymmetric disazo pigment has more polarized charge distribution compared to that of a symmetric disazo pigment, the asymmetric disazo pigment is generally highly sensitive to light and is preferably used as a charge generating material in an electrophotographic photoconductor, whereby obtaining a high quality image can be achieved.

Among the asymmetric disazo pigments, particularly, a compound that contains a fluorenone structure as a central skeleton represented by the general formula (III), (III)

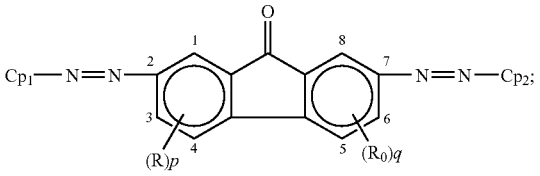

, such as A-20 through A-25, is preferred.

The compounds not only have a high sensitivity to light but also are preferable in view of their stability of electrical potential. Additonally, since the compounds have a comparatively large ionization potential, the compounds match to more charge transfer materials and thus a high quality image is easier to obtain.

In the present invention, the coupling of the conditions of the light-writing system (the writing resolution and the beam diameter) and the structure of the photoconductor film (the charge generating layer and the charge transfer layer) is unique and different from any of conventional techniques (Japanese Laid-Open Patent Application Nos. 8-286470, 9-319164, and 11-95462). Also, from the above-mentioned experiment by the inventors, it is obvious that image quality can be further improved when the thickness of the charge transfer (CT) layer is equal to or less than 20 μm.

The present invention is not limited to the specifically disclosed embodiment, and variations and modifications may be made without departing from the scope of the present invention.

The present application is based on Japanese priority application No.2002-016250 filed on Jan. 24, 2002, the entire contents of which are hereby incorporated by reference.

What is claimed is:

1. An image formation apparatus comprising;

a photoconductor, a charging means for charging a surface of the photoconductor at a desired electric potential, a light-writing means for performing light-writing having a resolution of equal to or more than 1200 dpi using a laser light beam with a beam diameter of equal to or less than 25 μm to form a latent image on the surface of the photoconductor, and said light writing being performed based on image data obtained by applying a halftone processing at a line frequency of equal to or more than 200 lpi to an input image, wherein said photoconductor comprises a conductive support, a charge generating layer comprising a charge generating material, and a charge transfer layer comprising a charge transfer material, said charge generating layer and said charge transfer layer being laminated on said conductive support, and the ionization potential of said charge generating material Ip(CG) and the ionization potential of said charge transfer material Ip(CT) satisfy relationship (I);

$$Ip(CG) \geqq Ip(CT) \quad \text{(I)},$$

said light-writing is performed based on image data formed by applying said halftone processing to said input image, wherein said charge transfer material is selected from the group consisting of

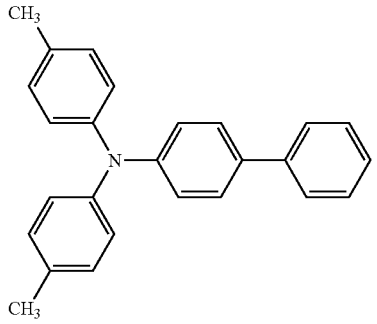

, and

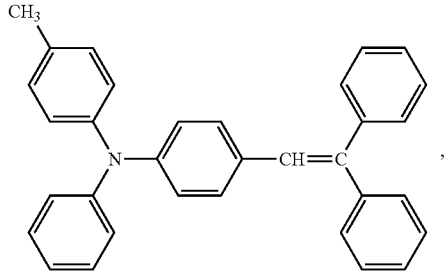

, said charge generating material is selected from the group consisting of

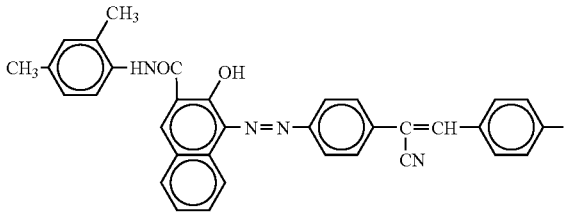

-continued

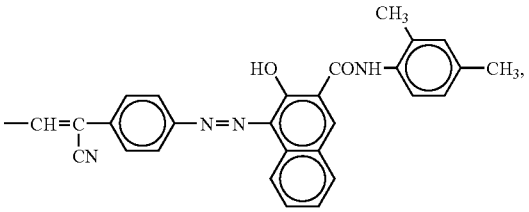

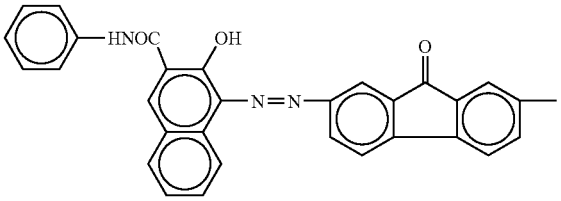

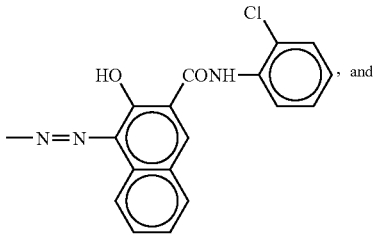

, and

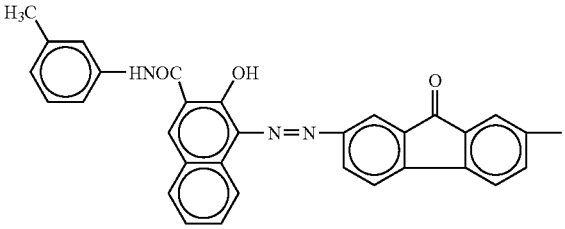

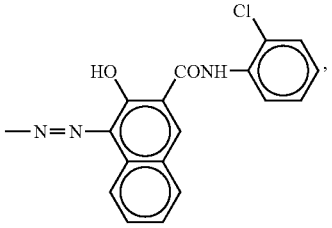

, wherein the photoconductor provides an image quality tone of 0.980 or greater.

2. The image formation apparatus as caimed in claim 1, wherein the thickness of said charge transfer layer is equal to or less than 20 μm.

3. The image formation apparatus as claimed in claim 1, wherein the line frequency for said halftone processing is equal to or more than 240 lpi.

4. The image formation apparatus as claimed in claim 1, wherein the charging means is a contact roller charging device and the light-writing means is a light-exposure means that comprises a laser diode as a light source.

5. The image formation apparatus as claimed in claim 1, wherein the charge generating material is

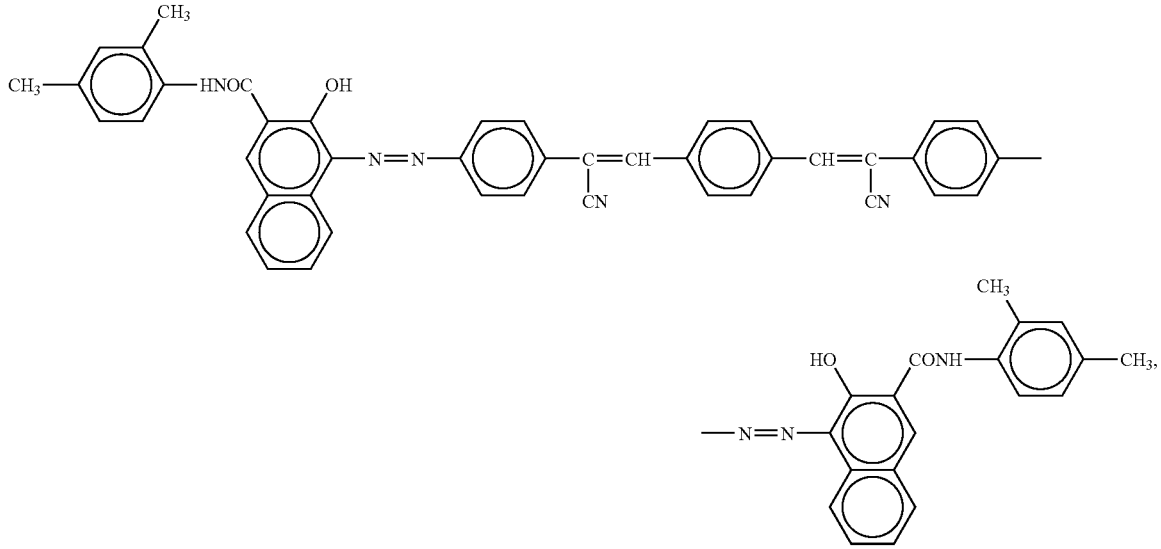

and the charge transfer material is

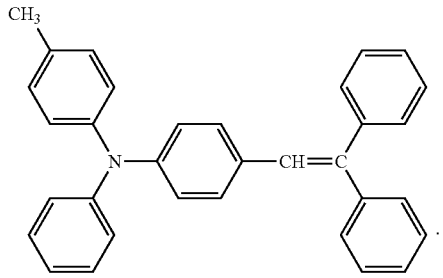

6. The image formation apparatus as claimed in claim 5, wherein the charging means is a contact roller charging device and the light-writing means is a light-exposure means that comprises a laser diode as a light source.

7. The image formation apparatus as claimed in claim 1, wherein the photoconductor has a charge transfer layer having a thickness of from 20 to 35 μm.

8. The image formation apparatus as claimed in claim 1, wherein the photoconductor has a charge transfer layer having a thickness of from 26 to 35 μm.

9. The image formation apparatus as claimed in claim 1, wherein the photoconductor provides an image quality tone of from 0.982 to 0.984.

* * * * *